US006460496B2

(12) United States Patent
Fukuhara et al.

(10) Patent No.: US 6,460,496 B2
(45) **Date of Patent: *Oct. 8, 2002**

(54) VALVE TIMING CONTROL DEVICE

(75) Inventors: Katsuyuki Fukuhara, Kobe; Hiroyuki Kinugawa; Makoto Yamauchi, both of Tokyo, all of (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/014,433

(22) Filed: Dec. 14, 2001

(65) Prior Publication Data

US 2002/0078913 A1 Jun. 27, 2002

Related U.S. Application Data

(63) Continuation-in-part of application No. 09/891,172, filed on Jun. 26, 2001, now Pat. No. 6,374,788.

(30) Foreign Application Priority Data

Dec. 25, 2000 (JP) ..... 2000-393403
Nov. 28, 2001 (JP) ..... 2001-363252

(51) Int. Cl.[7] ..... F01L 1/344
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 5,823,152 A * 10/1998 Ushida ..... 123/90.17
5,943,989 A * 8/1999 Kira ..... 123/90.17
6,014,952 A * 1/2000 Sato et al. ..... 123/90.17
6,173,687 B1 * 1/2001 Fukuhara et al. ..... 123/90.17
6,302,072 B1 * 10/2001 Sekiya et al. ..... 123/90.17

FOREIGN PATENT DOCUMENTS

JP 10-159514 6/1998
JP 10-159519 6/1998

* cited by examiner

*Primary Examiner*—Wellun Lo
(74) *Attorney, Agent, or Firm*—Sughrue Mion, PLLC

(57) ABSTRACT

A valve timing control device includes a purge path communicating between a hydraulic chamber allowing the entry of hydraulic pressure on starting an engine and a backward pressurized section in an accommodation hole. When the hydraulic chamber allowing the entry of hydraulic pressure on starting the engine is the retardation side hydraulic chamber, a hydraulic pressure derived from an oil pump is supplied to the retardation side hydraulic chamber on starting the engine. On the way, air-mixed oil is discharged to outside of the device by way of a purge path, a backward pressurized section in the accommodation hole and the discharge hole. When the air is discharged, a residual pressure is produced in the backward pressurized section due to oil supplied thereto. The residual pressure results in the increase of an unlocking hydraulic pressure to prevent a locking member from being unlocked. When the application of a retardation side hydraulic pressure is switched to that of an advance side hydraulic pressure, the pressure presses a front end of a locking member against only a biasing force of a biasing means to unlock a locking relation. The valve timing control device allows the use of any kinds of locking pins, and prevents the occurrence of beat noise (abnormal noise) when air-mixed oil unlocks a locking relation on starting the engine.

19 Claims, 19 Drawing Sheets

VALVE TIMING CONTROL DEVICE

CROSS REFERENCE

This application is a continuation-in-part of Ser. No. 09/891,172, filed Jun. 26, 2001 now U.S. Pat. No. 6,374,788.

BACKGROUND OF THE INVENTION

1. Field of the Invention

The present invention relates to a valve timing control device altering timing for the closing and opening of an exhaust valve or intake valve of an internal-combustion engine (hereafter, referred as an engine) with reference to any operating conditions.

2. Description of the Prior Art

Conventional valve timing control devices shown in FIG. 1 to FIG. 5 for example are known. FIG. 1 is a lateral cross sectional view of an internal construction of a conventional vane-equipped valve timing control device. FIG. 2 is a longitudinal cross sectional view taken along lines A—A of FIG. 1. FIG. 3 is a longitudinal cross sectional view of a conventional locking/unlocking mechanism shown in FIG. 2. FIG. 4 is an enlarged perspective view of an important part of a locking/unlocking mechanism of the conventional valve timing control device shown in FIG. 1. FIG. 5 is a graph of a relationship between an operational stroke of a locking member of the conventional locking mechanism shown in FIG. 2 and FIG. 3 and a hydraulic pressure exerted on the locking member. Moreover, in FIG. 2, right side is defined as forward and left side is defined as backward. In FIG. 3 and FIG. 4, lower side is defined as forward and upper side is defined as backward.

In the drawings, a reference numeral 1 denotes a first rotor, which is coupled to a crankshaft (not shown) as an output shaft of the engine by way of chains (not shown), belts (not shown) and so on and is rotatable in synchronization with the crankshaft (not shown). The first rotor 1, a sprocket 2, a case 3 and a cover 4 are fixed integrally using a threaded member 5 such as bolts. The sprocket 2 is rotated integrally with the crankshaft (not shown). The case 3 has a plurality of shoes 3*a* projected inwardly from an inner periphery of the case 3 to constitute a plurality of hydraulic chambers. The hydraulic chambers are covered with the cover 4.

A rotor (second rotor) 6 is rotated relative to the first rotor 1 and is disposed in the case 3. The rotor 6 is integrally fixed on a camshaft 7, which relates to timing for the closing and opening of intake or exhaust valve, using a threaded member 8 such as bolts. The rotor 6 has a plurality of vanes 6*a* each partitioning the hydraulic chambers, which are constituted by the shoes 3*a* of the case 3, into an advance side hydraulic chamber 9 and a retardation side hydraulic chamber 10. A first oil path (hydraulic chamber supply path) 11 and a second oil path (hydraulic chamber supply path) 12 are arranged in the camshaft 7. The first oil path 11 supplies a hydraulic pressure to the advance side hydraulic chamber 9 and discharges the hydraulic pressure therefrom. The second oil path 12 supplies a hydraulic pressure to the retardation side hydraulic chamber 10 and discharges the hydraulic pressure therefrom.

Seal means 13 are disposed at front ends of the shoes 3*a* of the case 3 and at front ends of the vanes 6*a* of the rotor, respectively. Each of the seal means 13 prevents an oil leak from a boundary between the advance side hydraulic chamber 9 and the retardation side hydraulic chamber 10. The seal means 13 includes a seal member 13*a* sliding over an inner wall of the advance side hydraulic chamber 9 or the retardation side hydraulic chamber 10 and a leaf spring 13*b* pressing the seal member 13*a* against the inner wall thereof.

An accommodation hole 14 accommodating a locking pin described later is arranged at one of the vanes 6*a* of the rotor 6 as the second rotor. The locking pin (locking member, lockingmechanism) 15, which controls relative rotation of the first rotor 1 and the second rotor and is defined as a straight pin having a cylindrical shape, is disposed in the accommodation hole 14. The locking pin 15 prevents the occurrence of beat noise (abnormal noise). The second rotor 6 vibrates in rotational directions due to loads of cams (not shown) integrally fixed to the camshaft 7 when the engine is started in a state of hydraulic pressure-free in the valve timing control device. The rotor 6 attaches repeatedly to or detaches from the first rotor 1 due to the vibration. Therefore, the beat noise occurs due to the repetition. the locking pin 15 is pressed against the first rotor 1 at all times using a biasing means (locking mechanism) 16 such as coil springs disposed between a rear wall of the accommodation hole 14 and the locking pin 15 and engages in an engagement hole described later. A discharge hole (unlocking mechanism) 17, which discharges a backward pressure exerted on the back section of the locking pin 15 to outside of the device, is formed in the accommodation hole 14.

On the other hand, an engagement hole 18 is formed at a position of the sprocket 2 defined as the first rotor 1. The position of the sprocket 2 allows the fit of the locking pin 15 into the engagement hole 18 when the rotor 6 defined as the second rotor locates at the most retarded position with respect to the first rotor 1.

A check valve (unlocking mechanism) 19 is arranged at the vane 6*a* having the accommodation hole 14. The check valve 19 selects the higher pressure of the two different pressures in the advance and retardation side hydraulic chambers 9 and 10, and supplies the selected pressure to the engagement hole 18 engaged with the locking pin 15 to unlock the engagement (hereafter, referred as locking relation). The check valve 19 communicates to the engagement hole 18 by way of a first unlocking hydraulic pressure supply path (unlocking mechanism) 20 formed in the vane 6*a* of the rotor 6, a second unlocking hydraulic pressure supply path (unlocking mechanism) 21 formed in the sprocket 2. The check valve 19 communicates to the advance side hydraulic chamber (unlocking mechanism) 9 by way of an advance side partitioned pressure path (unlocking mechanism) 22. The check valve communicates to the retardation side hydraulic pressure chamber 10 by way of a retardation side partitioned pressure path (unlocking mechanism) 23.

An unlocking operation will be explained hereafter.

On unlocking the locking relation, a hydraulic pressure derived from an oil pump (not shown) passes through the advance side hydraulic chamber 9 or the retardation side hydraulic chamber 10. The hydraulic pressure is then supplied to the engagement hole 18 through the check valve 19, the first and second unlocking partitioned pressure paths 20 and 21. In the engagement hole 18, an unlocking hydraulic pressure is supplied to a boundary between the inner wall of the engagement hole 18 and an outer wall of the locking pin 15 and presses the locking pin 15 against a biasing force of the biasing means 16. In this way, the locking pin 15 is moved back the deep of the accommodation hole 14 and is released from the engagement hole 18. At this time, the backward pressure of the locking pin 15 is discharged from the accommodation hole 14 through the discharge hole 17 to outside of the valve timing control device. When a front end of the locking pin 15 is released from the engagement hole 18 and the whole is come back to the accommodation hole 14, it is possible to unlock the locking relation to allow a free rotation of the first and second rotors.

Moreover, since a pressure-exerted area, on which a hydraulic pressure is exerted, of the locking pin 15 is constant over a period of time during the switching from a locked state due to the locking pin 15 to an unlocked state, a discharge speed of the backward pressure becomes constant. The operational stroke of the locking pin 15 is determined depending on the biasing force of the biasing means 16 and the hydraulic pressure to establish the one-on-one relationship between the operational stroke of the locking pin 15 and an applied hydraulic pressure as illustrated in FIG. 5. A nun locking hydraulic pressure is the same as a hydraulic pressure (unlocking-keeping hydraulic pressure) keeping the unlocking hydraulic pressure.

Incidentally, in a state of stopping the engine, oil in the advance side hydraulic chamber 9 and the retardation side hydraulic chamber 10 comes down to an oil pan (not shown) by way of the first oil path 11, the second oil path 12 and soon. It results in remaining air in the respective hydraulic chambers and pipes such as oil paths. In such a state, on restarting the engine, a hydraulic pressure rises due to the oil pump (not shown) and simultaneously the air remained in the pipes is pressed at a dash to the valve timing control device. As a result, air-mixed oil in the valve timing control device is supplied to the engagement hole 18 to exert on the locking pin 15.

The conventional valve timing control device is however configured as described above. When air-mixed oil exerts on the locking pin 15 to unlock the locking relation on starting the engine, the hydraulic pressure in the advance side hydraulic chamber 9 and the retardation side hydraulic chamber 10 can hardly absorb the loads of the cams. Since the second rotor therefore attaches repeatedly to or detaches from the first rotor 1, it is difficult to prevent the occurrence of the beat noise (abnormal noise) due to the repetition.

Moreover, another conventional valve timing control devices disclosed in JP-A-159519/1998, for example, are also known. It is an object of the conventional device to provide a device having no problems that the air-mixed oil unlocks accidentally the locking relation of a tier-equipped pin and an engagement hole before a hydraulic pressure adequately rises on starting the engine and so on. The device is equipped with an unlocking hydraulic chamber formed between a shoulder section of the tier-equipped pin and an accommodation hole, and is equipped with a communication path communicating between the unlocking hydraulic chamber and a retardation side hydraulic chamber. The device is also equipped with a pressure release path communicating between a discharge hole formed in the accommodation hole, which accommodates the tier-equipped pin, and the unlocking hydraulic chamber in order to discharge only the air to outside.

However, the conventional valve timing control device is so configured as to allow oil and air (pressurized fluid), which reach the pressure release path, to pass through the unlocking hydraulic chamber. Here, when the air-mixed oil in trace amounts exerts on the shoulder section of the tier-equipped pin, the pressure release path is sealed with oily components of the air-mixed oil and accordingly the discharge of air is hardly performed. Therefore, there is a possibility that the locking relation of the tier-equipped pin is unlocked before the hydraulic pressure adequately rises and the conventional device cannot solve the problems above.

On the other hand, Japanese Patent No. 3,085,219 discloses a valve timing control device having a structure allowing to block a communication path with a tier-equipped pin, the communication path communicating between an unlocking hydraulic chamber and a retardation side hydraulic chamber on unlocking a locking relation. With the conventional valve timing control device, an advance side hydraulic pressure is applied to a boundary between a front end of the tier-equipped pin and an engagement hole and accordingly it is possible to unlock the locking relation. When the locking relation is unlocked at one time and the tier-equipped pin is moved back, the communication path is opened. In this way, it is possible to keep the unlocked state using not only the advance side hydraulic pressure but also a retardation side hydraulic pressure.

The conventional valve timing control device is however configured as described above. When the locking relation is unlocked due to the application of the advance side hydraulic pressure and the retardation side hydraulic chamber communicates to the unlocking hydraulic chamber by way of the communication path, the unlocking hydraulic chamber is not yet filled with oil at this time. Therefore, when the application of the advance side hydraulic pressure is switched to the application of the retardation side hydraulic pressure, the hydraulic pressure does not exert adequately on the tier-equipped pin. Thus, there is a possibility that the tier-equipped pin moves forward due to a biasing force of a biasing means biasing the tier-equipped pin toward an engagement hole at all times and that the tier-equipped pin engages in the engagement hole.

Any devices disclosed in the gazettes above are predicated on using the tier-equipped pin and it is difficult to use a straight pin usable in the conventional valve timing control device shown in FIG. 1 to FIG. 5. The tier-equipped pin and a sliding hole allowing the insertion of the locking pin are produced in more complicated processes as compared with the straight pin. It is desirable that the valve timing control device has general versatility allowing the use of any kinds of locking pins.

SUMMARY OF THE INVENTION

Accordingly, it is an object of the present invention to provide a valve timing control device allowing the use of any kinds of locking pins, and preventing the occurrence of beat noise (abnormal noise) when air-mixed oil unlocks a locking relation on starting the engine.

In order to achieve the object of the present invention, we provide a valve timing control device, comprising: a first rotor rotatable in synchronization with a crank shaft of an internal-combustion engine and having a plurality of shoes formed at an inner periphery of the first rotor; a second rotor fixed at an end of an intake or exhaust camshaft of the internal-combustion engine, arranged in the first rotor, rotatable relative to the first rotor, and having a plurality of vanes formed at an outer periphery of the second rotor; an advance side hydraulic chamber and a retardation side hydraulic chamber formed between the vanes of the second rotor and the shoes of the first rotor; a locking member locking either of the first and second rotors with respect to the remainder at a required angle; an accommodation hole arranged at either of the first and second rotors, accommodating the locking member and a biasing means biasing the locking member, and having a discharge hole discharging a backward pressure exerted on aback section of the locking member to outside; an engagement hole arranged at the remainder, allowing the insertion of the locking member; an unlocking hydraulic chamber; and an unlocking hydraulic pressure supply path supplying a hydraulic pressure to the unlocking hydraulic chamber; wherein at least one of the advance and retardation side hydraulic chambers is equipped with a purge path communicating to the atmosphere. In this way, air or air-mixed oil having the potential for being used in first motion of the unlocking operation on starting the engine can be discharged positively to outside. Therefore, it is possible to unlock the locking relation after the applied hydraulic pressure reaches a level of allowing the control of the valve timing control device and to prevent the occurrence of the beat noise (abnormal noise) with reliability.

With the above arrangement, it may further comprises a check valve having an advance side partitioned pressure path communicating the advance side hydraulic chamber and having a retardation side partitioned pressure path communicating the retardation side hydraulic chamber, the check valve selecting the higher pressure of the two different pressures in the advance and retardation side hydraulic chambers to supply the selected pressure to the unlocking hydraulic pressure supply path, wherein at least one of the advance side hydraulic chamber, the retardation side hydraulic chamber, the advance side partitioned pressure path and the retardation side partitioned pressure path is equipped with a purge path communicating to the atmosphere. In this way, air or air-mixed oil used in first motion of the unlocking operation on starting the engine can be discharged positively to outside. It is unnecessary to devote all pressure produced in the first motion to the unlocking operation. Therefore, it is possible to unlock the locking relation after the applied hydraulic pressure reaches a level of allowing the control of the valve timing control device and to prevent the occurrence of the beat noise (abnormal noise) with reliability.

With the above arrangement, the purge path may be connected to a backward pressurized section in the accommodation hole, the backward pressurized section functioning as a backward pressurized chamber for the locking member. In this way, a hydraulic pressure produced due to air-mixed oil, which is supplied to the backward pressurized section in the accommodation hole by way of the purge path, competes against an unlocking hydraulic pressure supplied to the engagement hole by way of the unlocking hydraulic pressure supply path. Therefore, it is possible to delay the unlocking operation and accordingly prevent the occurrence of the beat noise (abnormal noise) with reliability.

With the above arrangement, a drain path communicating between the purge path and the atmosphere may be connected to the backward pressurized section in the accommodation hole, the backward pressurized section functioning as a backward pressurized chamber for the locking member. In this way, it is possible to discharge quickly the air-mixed oil due to the drain path with the locking relation being unlocked.

With the above arrangement, the purge path may communicate at least one of the retardation side hydraulic chamber, the advance side hydraulic chamber, the retardation side partitioned pressure path or the advance side partitioned pressure path to the atmosphere. In this way, air-mixed oil is supplied to the accommodation hole by way of at least one of the retardation side hydraulic chamber, the advance side hydraulic chamber, the retardation side partitioned pressure path or the advance side partitioned pressure path, and the purge path to produce a hydraulic pressure. The hydraulic pressure competes against an unlocking hydraulic pressure supplied to the engagement hole by way of the unlocking hydraulic pressure supply path. Therefore, it is possible to delay the unlocking operation at a low hydraulic pressure on starting the engine and so on.

With the above arrangement, the purge path may be connected to the backward pressurized section in the accommodation hole so that the purge path is blocked with the locking member in a state of unlocking the locking relation. In this way, when the locking relation is unlocked after the air-mixed oil is discharged to outside, the supply of a hydraulic pressure derived from the purge path to the accommodation hole is cutoff. Therefore, it is possible to prevent the residual pressure from being produced in the accommodation hole.

With the above arrangement, the purge path may be connected to the backward pressurized section in the accommodation hole so that the purge path is blocked with the locking member over a period of time during from the state of starting a locking operation to the state of moving the locking member by a required stroke. In this way, the supply of a hydraulic pressure derived from the purge path to the accommodation hole is cut off over the period of time above. Therefore, it is possible to prevent the residual pressure from being produced in the accommodation hole.

With the above arrangement, at least one part of the purge path, the discharge hole, the drain path, the retardation side partitioned pressure path of the check valve or the unlocking hydraulic pressure supply path may be equipped with a throttle for narrowing an opening area of them. In this way, when the purge path is equipped with the throttle, it is possible to increase resistance produced in the purge path and to restrict to pass oil, which has incompressibility and high-viscosity, in the air-mixed oil through the purge path. At the same time, it is possible to pass selectively air, which has compressibility and low-viscosity, through the purge path. When the discharge hole or the drain path is equipped with the throttle, it is possible to restrict to discharge the oil. In case a malfunction occurs mechanically in the locking pin in the locked state to remain the purge path to be opened for any reason, it is possible to reduce the amount of oil consumed repeatedly to a minimum level. Therefore, it is possible to avoid engine failure from causing owing to lack of lubricant. When the retardation side partitioned pressure path or the unlocking hydraulic pressure supply path includes the throttle, it is possible to direct the amount of air-mixed oil, which is more than that of the retardation side partitioned pressure path or the unlocking hydraulic pressure supply path, toward the purge path.

With the above arrangement, an opening area of the purge path may be set to be narrower than that of a pressurized chamber supply path supplying a hydraulic pressure to the advance side hydraulic chamber or the retardation side hydraulic chamber. In this way, it is possible to keep a hydraulic pressure in the advance side hydraulic chamber and the retardation side hydraulic chamber.

With the above arrangement, the opening area of the purge path may be set to be equal to or be larger than that of the discharge hole or the drain path. In this way, it is possible to produce a residual pressure in a direction of delaying the unlocking operation on starting the engine. Further, it is possible to set the unlocking hydraulic pressure to become higher than the unlocking-keeping hydraulic pressure and to prevent the locking relation from being unlocked accidentally on starting the engine. As a result, it is possible to prevent the occurrence of the beat noise (abnormal noise) with reliability.

With the above arrangement, the opening area of the purge path may be set to be larger than that of any one of the advance side partitioned pressure path, the retardation side partitioned pressure path and the unlocking hydraulic pressure supply path. In this way, it is possible to direct air-mixed oil toward the purge path having higher priority than the unlocking hydraulic pressure supply path. It is possible to restrict to pass oil, which has incompressibility and high-viscosity, in the air-mixed oil through the purge path and to pass selectively air, which has compressibility and low-viscosity, through the purge path. As a result, it is possible to prevent the occurrence of the beat noise (abnormal noise) with reliability.

With the above arrangement, opening areas of the pressurized chamber supply path, the purge path, the drain path and the unlocking hydraulic pressure supply path may be so set as to satisfy the following inequality: the pressurized chamber supply path≧the purge path≧the drain path≧the unlocking hydraulic pressure supply path. In this way, it is possible to direct air-mixed oil toward the purge path having higher priority than the unlocking hydraulic pressure supply path. It is possible to restrict to pass oil, which has incompressibility and high-viscosity, in the air-mixed oil through the purge path and to pass selectively air, which has compressibility and low-viscosity, through the purge path.

With the above arrangement, the opening areas may be so set as to produce a pressure different between an unlocking hydraulic pressure and an unlocking-keeping hydraulic pressure. In this way, it is possible to set the unlocking hydraulic pressure to become higher than the unlocking-keeping hydraulic pressure and to prevent the locking relation from being unlocked accidentally on starting the engine. As a result, it is possible to prevent the occurrence of the beat noise (abnormal noise) with reliability.

With the above arrangement, a biasing force of a biasing means may be so set as to produce a pressure different between an unlocking hydraulic pressure and an unlocking-keeping hydraulic pressure. In this way, it is possible to set the unlocking hydraulic pressure to become higher than the unlocking-keeping hydraulic pressure and to prevent the locking relation from being unlocked accidentally on starting the engine. As a result, it is possible to prevent the occurrence of the beat noise (abnormal noise) with reliability.

With the above arrangement, a pressure-exerted area of a tier-equipped locking member is so set as to produce a pressure different between an unlocking hydraulic pressure and an unlocking-keeping hydraulic pressure. In this way, it is possible to set the unlocking hydraulic pressure to become higher than the unlocking-keeping hydraulic pressure and to prevent the locking relation from being unlocked accidentally on starting the engine. As a result, it is possible to prevent the occurrence of the beat noise (abnormal noise) with reliability.

With the above arrangement, the unlocking hydraulic pressure of the locking member using either of the retardation side hydraulic pressure and the advance side hydraulic pressure may be set to be larger than a maximum hydraulic pressure in the engine or a relief valve hydraulic pressure. In this way, however a hydraulic pressure, which is supplied to either of the retardation side hydraulic chamber and the advance side hydraulic chamber, rises on starting the engine, the locking relation of both rotors cannot be unlocked due to the risen hydraulic pressure. Accordingly, it is possible to prevent the locking relation from being unlocked accidentally on starting the engine and to prevent the occurrence of the beat noise (abnormal noise) with reliability.

With the above arrangement, when the first and second rotors are locked, a hydraulic chamber allowing entry of a hydraulic pressure on starting the engine may communicate to an unlocking hydraulic chamber and the backward pressurized section in the accommodation hole, respectively. In this way, an unlocking hydraulic pressure and a backward pressure competing against the unlocking hydraulic pressure are exerted on the locking member in both directions. Therefore, it is possible to prevent the locking relation from being unlocked due to a hydraulic pressure of the hydraulic chamber allowing entry of hydraulic pressure on starting the engine. Moreover, it is possible to prevent the locking relation from being unlocked accidentally on starting the engine and to prevent the occurrence of the beat noise (abnormal noise) with reliability.

With the above arrangement, the locking member may be released from the engagement hole due to a hydraulic pressure of a hydraulic chamber opposite to the hydraulic chamber allowing the entry of hydraulic pressure on starting the engine, and wherein when the first and second rotors are unlocked, the purge path defined between the hydraulic chamber allowing the entry of hydraulic pressure on starting the engine and the backward pressurized section in the accommodation hole may be blocked with the locking member. In this way, it is possible to allow the unlocking operation only when a hydraulic pressure of a hydraulic chamber opposite to the hydraulic chamber allowing the entry of hydraulic pressure on starting the engine exerts on the locking member. When the locking relation is unlocked at one time, it is possible to ensure the unlocked state due to either of the hydraulic pressures.

With the above arrangement, the hydraulic chamber allowing the entry of hydraulic pressure on starting the engine may be the retardation side hydraulic chamber. In this way, it is possible to produce the residual pressure exerted on the locking member in a direction of locking the locking member due to the hydraulic pressure of the retardation side hydraulic chamber allowing the entry of hydraulic pressure. Accordingly, it is possible to prevent the locking relation from being unlocked due to the retardation side hydraulic pressure with reliability.

BRIEF DESCRIPTION OF THE DRAWINGS

FIG. 9A shows a locked state and FIG. 9B shows an unlocked state.

FIG. 12A shows a locked state and FIG. 12B shows an unlocked state.

FIG. 16A shows a locked state and FIG. 16B shows an unlocked state.

FIG. 20A shows a locked state and FIG. 20B shows an unlocked state.

DESCRIPTION OF THE PREFERRED EMBODIMENT OF THE INVENTION

Embodiments of the present invention will be hereafter explained.

Embodiment 1

Figure 1:
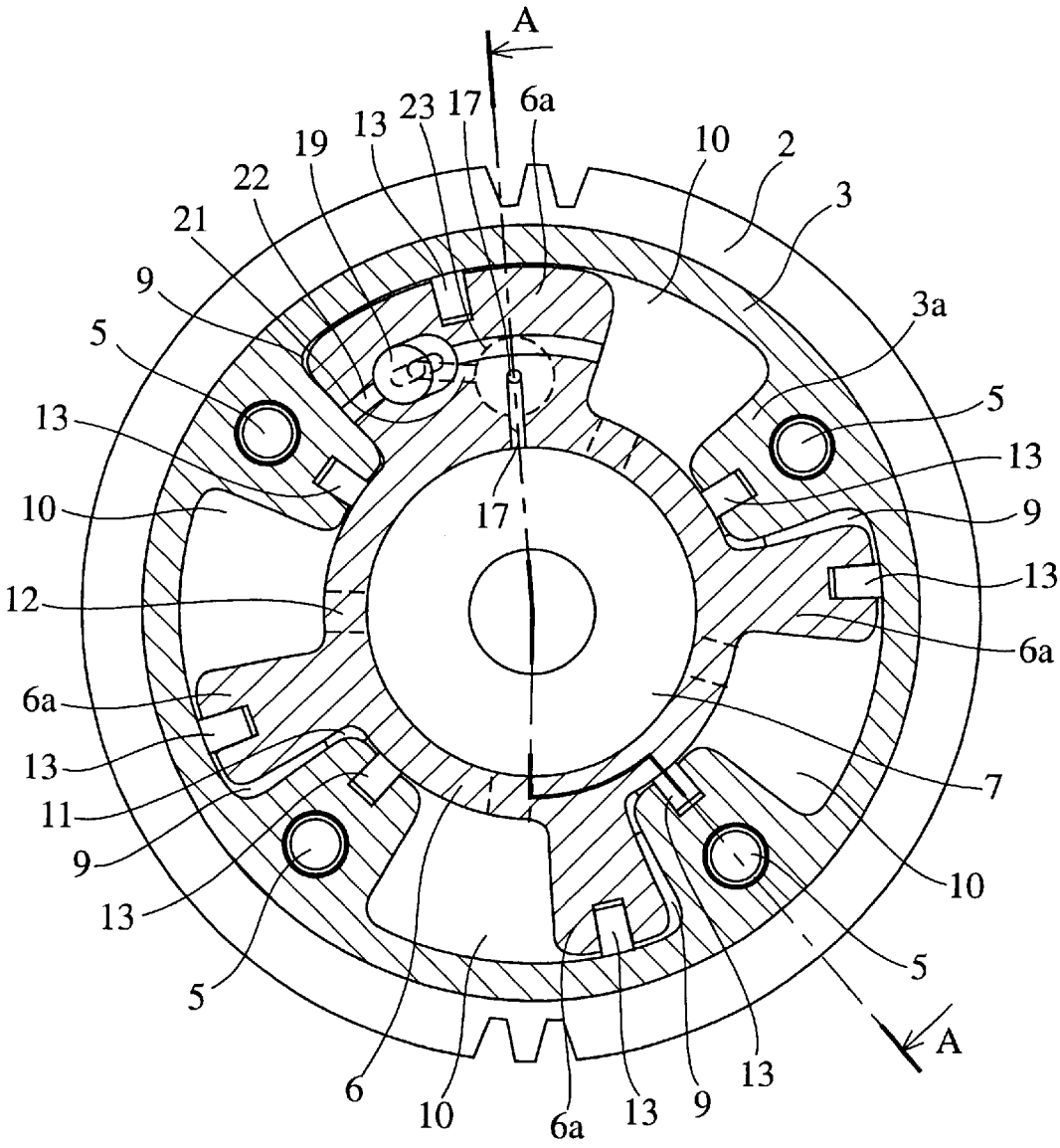
FIG.1 (PRIOR ART)
FIG. 1 is a lateral cross sectional view of an internal construction of a conventional vane-equipped valve timing control device.
Figure 2:
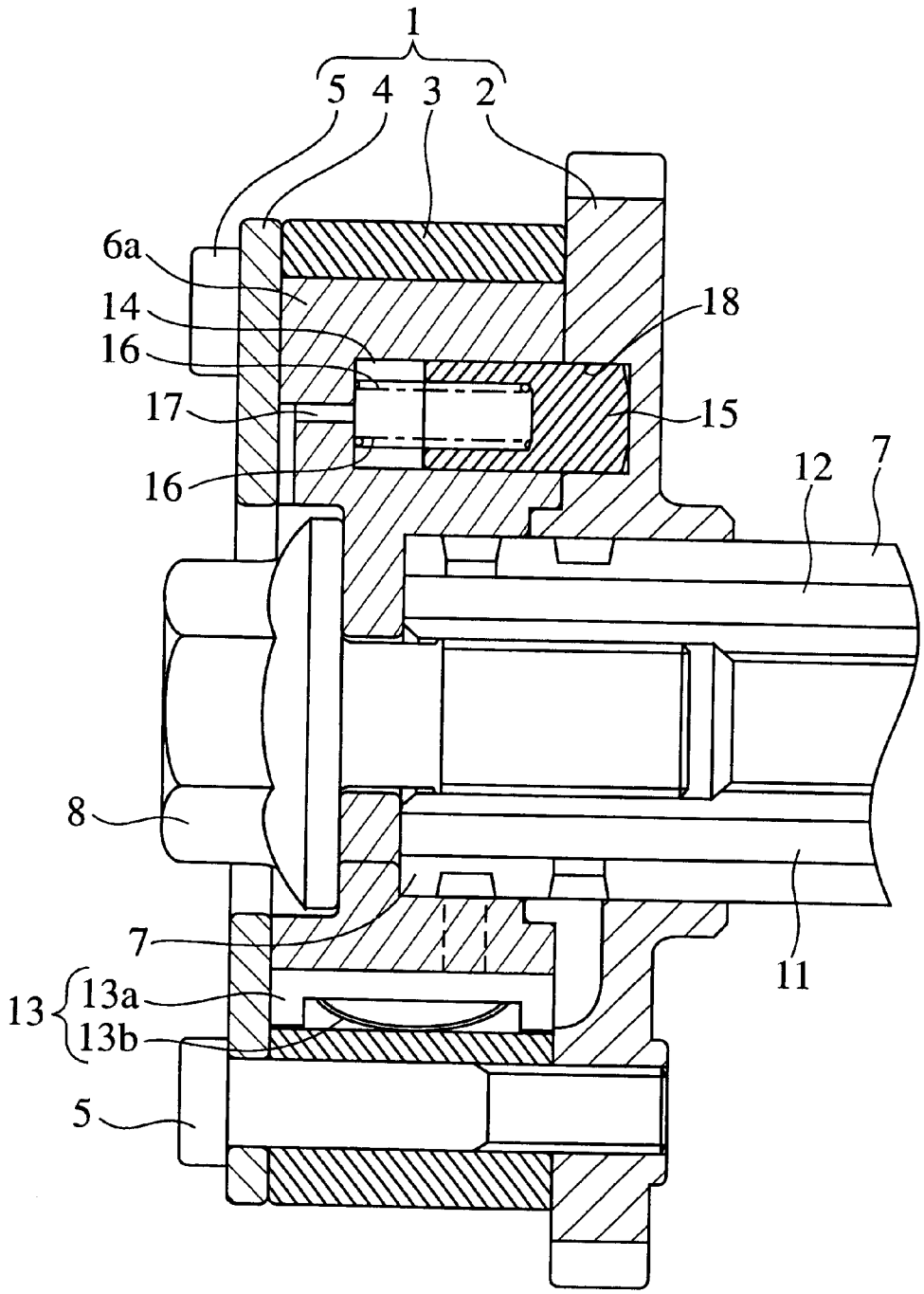
FIG.2 (PRIOR ART)
FIG. 2 is a longitudinal cross sectional view taken along lines A—A of FIG. 1.
Figure 3:
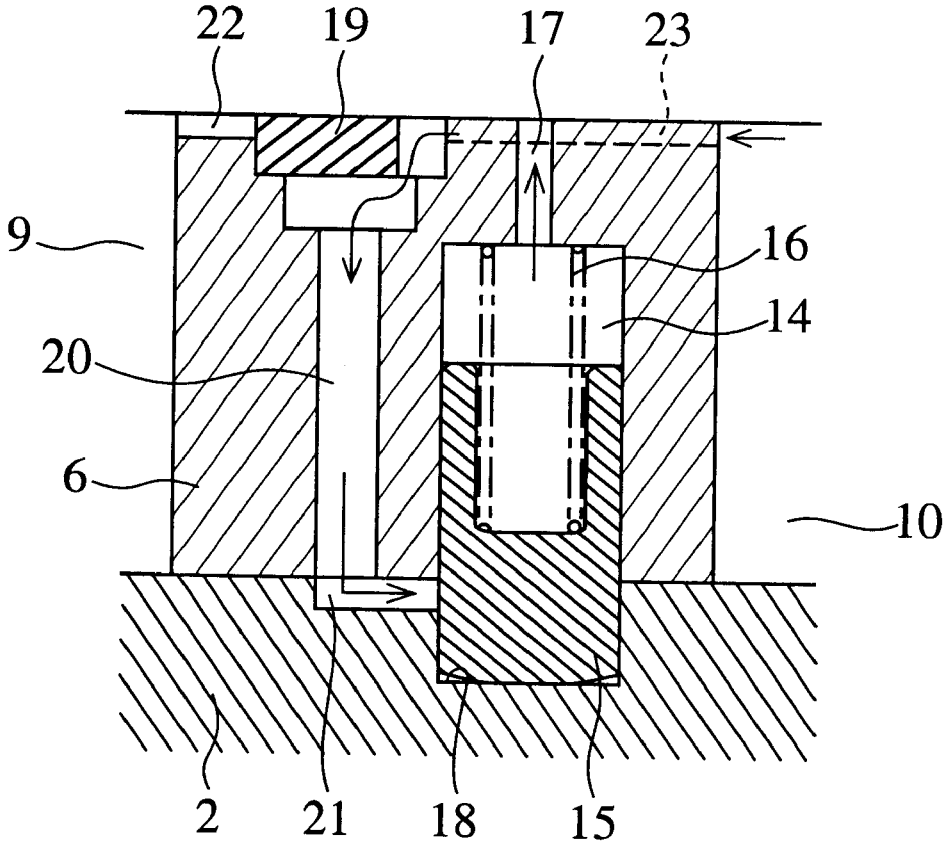
FIG.3 (PRIOR ART)
FIG. 3 is a longitudinal cross sectional view of a conventional locking/unlocking mechanism shown in FIG. 2.
Figure 4:
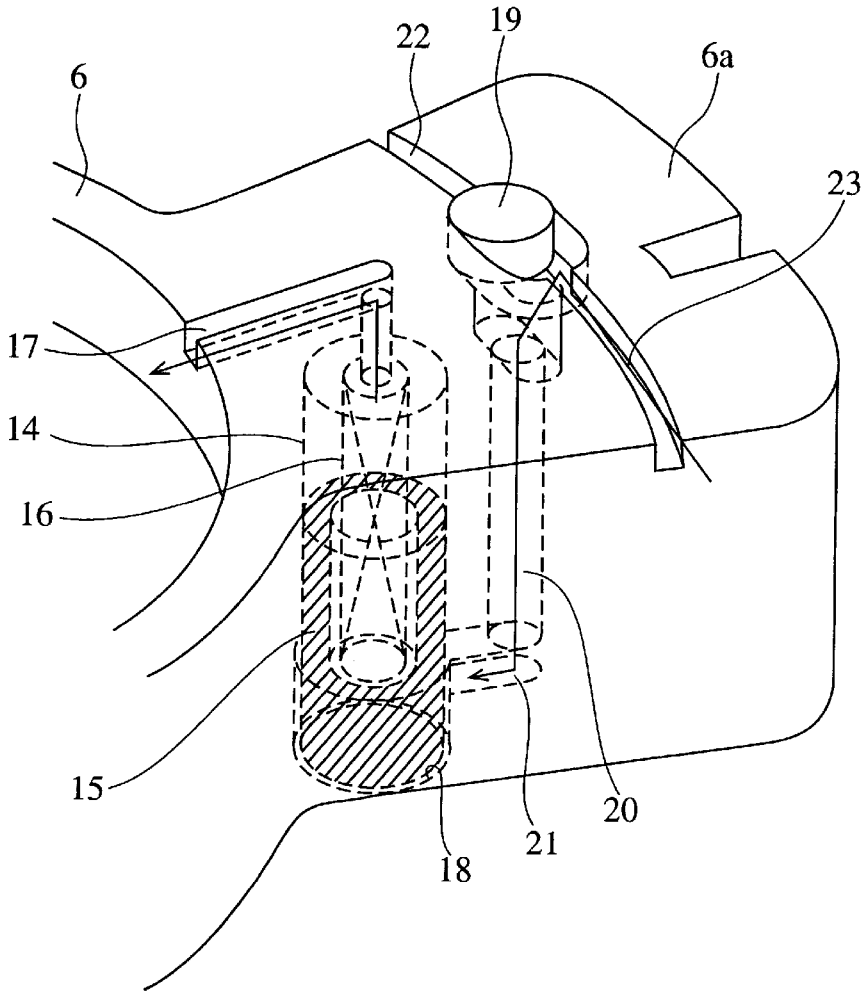
FIG.4 (PRIOR ART)
FIG. 4 is an enlarged perspective view of an important part of a locking/unlocking mechanism of the conventional valve timing control device shown in FIG. 1.
Figure 5:
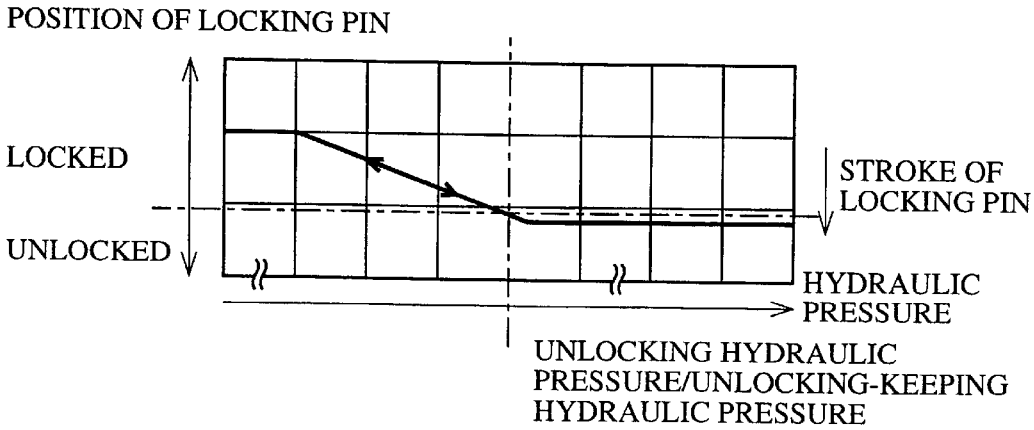
FIG.5 (PRIOR ART)
FIG. 5 is a graph of a relationship between an operational stroke of a locking member of the conventional locking mechanism shown in FIG. 2 and FIG. 3 and a hydraulic pressure exerted on the locking member.
Figure 6:
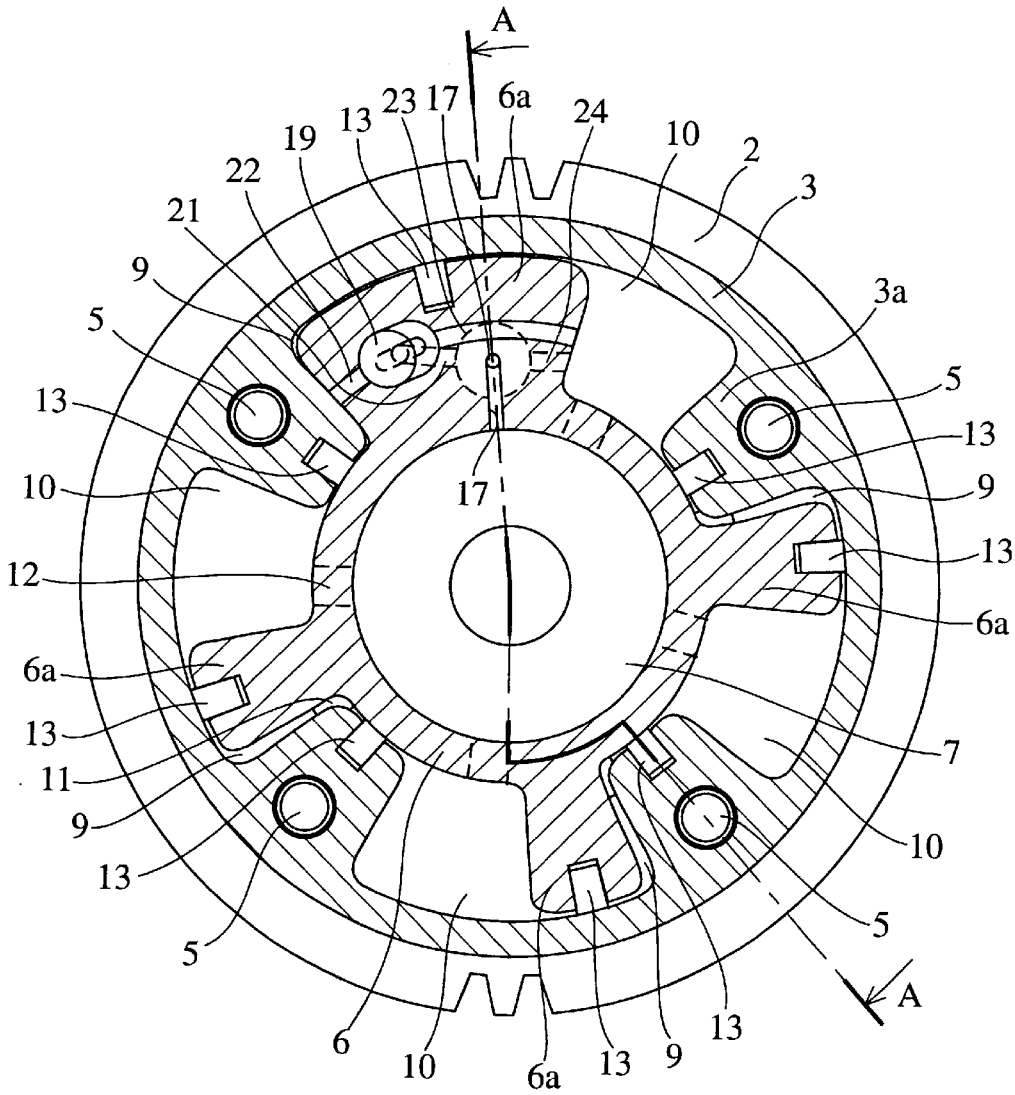
FIG. 6 is a lateral cross sectional view of an internal construction of a valve timing control device as embodiment 1 according to the present invention.
Figure 7:
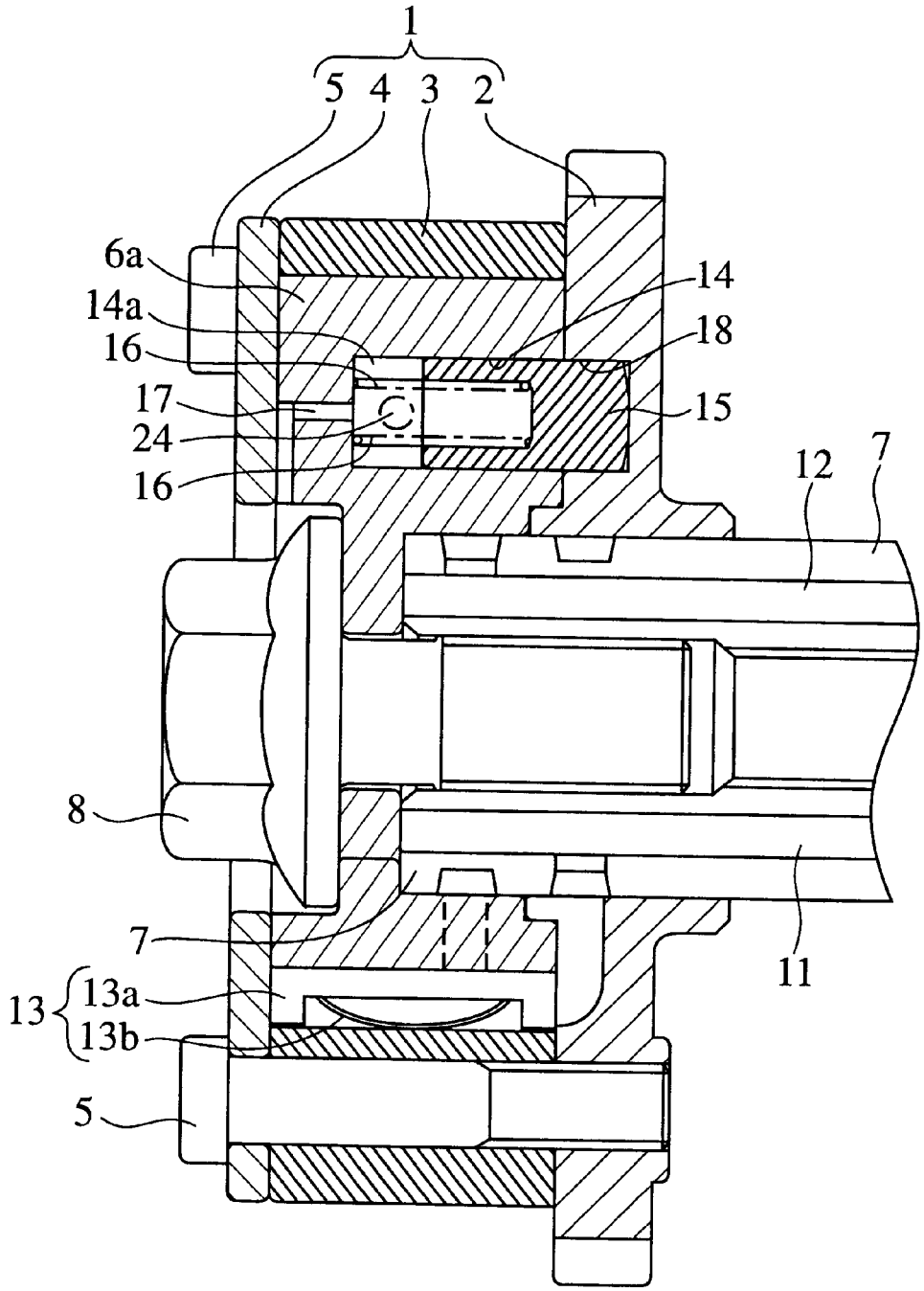
FIG. 7 is a longitudinal cross sectional view taken along lines A—A of FIG. 6.
Figure 8:
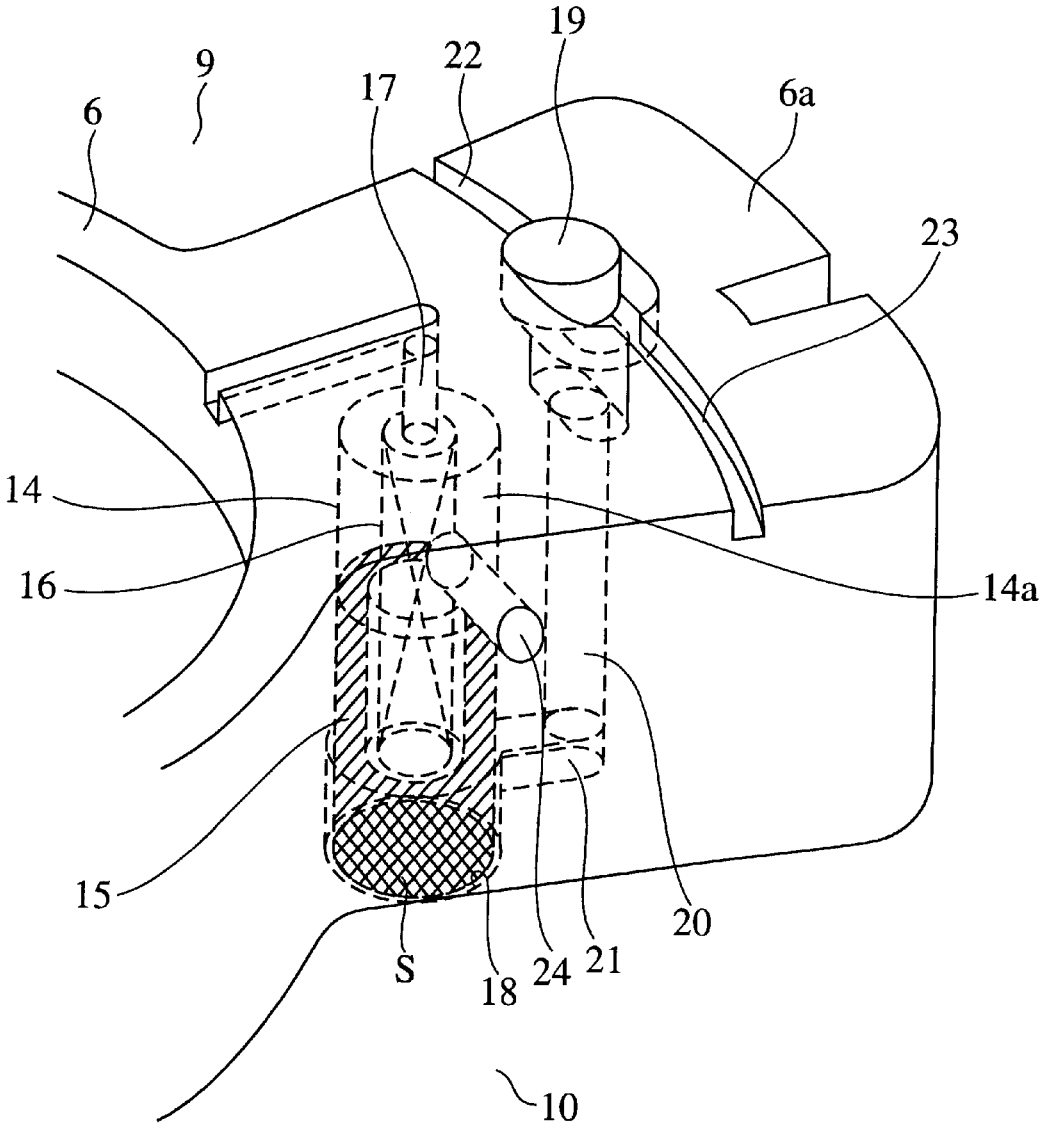
FIG. 8 is an enlarged perspective view of a locking/unlocking mechanism of the valve timing control device shown in FIG. 6 and FIG. 7.
Figure 9A:
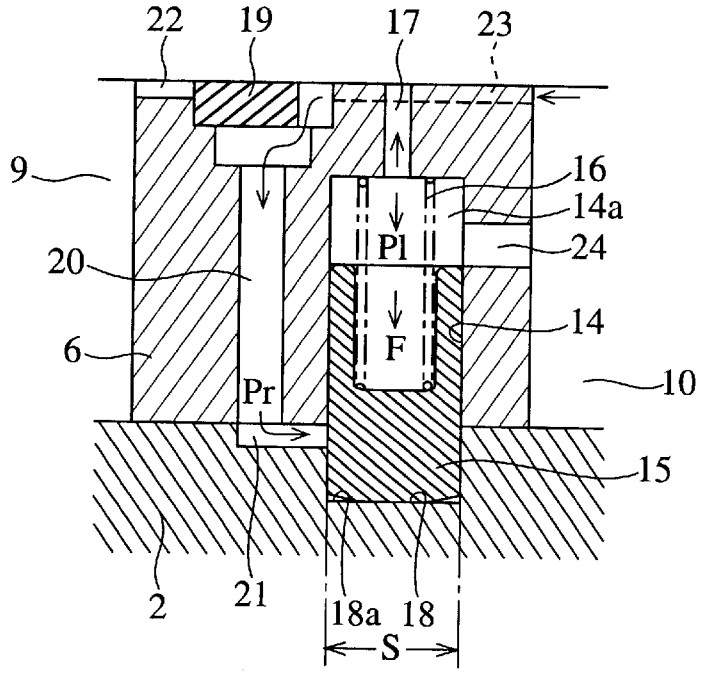
FIG. 9A and FIG. 9B are longitudinal cross sectional views of an operation of the locking/unlocking mechanism of the valve timing control device shown in FIG. 6 to FIG. 8.
Figure 9B:
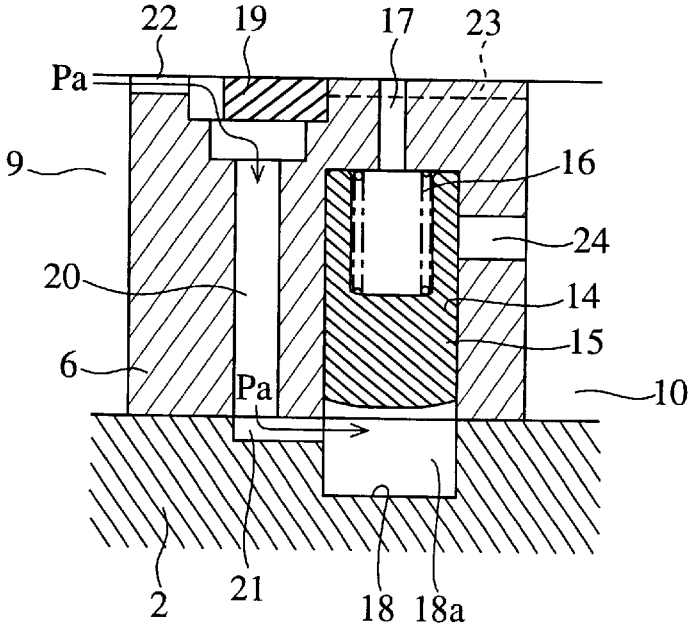
Figure 10:
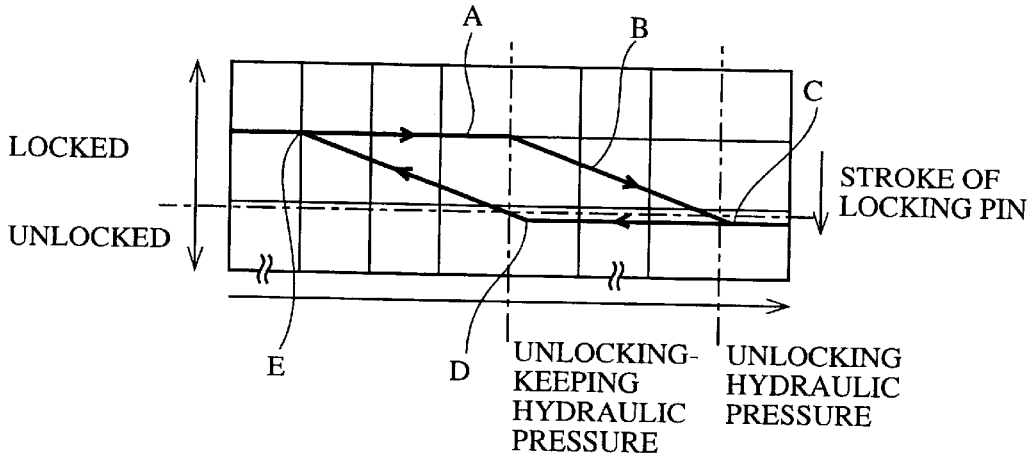
FIG. 10 is a graph of a relationship between an operational stroke of a locking member of the locking mechanism of the valve timing control device shown in FIG. 6 to FIG. 9B and a hydraulic pressure exerted on the locking mechanism.

FIG. 6 is a lateral cross sectional view of an internal construction of a valve timing control device as embodiment 1 according to the present invention. FIG. 7 is a longitudinal cross sectional view taken along lines A—A of FIG. 6. FIG. 8 is an enlarged perspective view of a locking/unlocking mechanism of the valve timing control device shown in FIG. 6 and FIG. 7. FIG. 9A and FIG. 9B are longitudinal cross sectional views of an operation of the locking/unlocking mechanism of the valve timing control device shown in FIG. 6 to FIG. 8, FIG. 9A shows a locked state and FIG. 9B shows an unlocked state. FIG. 10 is a graph of a relationship between an operational stroke of a locking member of the locking mechanism of the valve timing control device shown in FIG. 6 to FIG. 9B and a hydraulic pressure exerted on the locking mechanism. Components of the embodiment 1 common to those of the conventional valve timing control device shown in FIG. 1 to FIG. 5 are denoted by the same reference numerals and further description will be omitted.

The embodiment 1 is characterized in that the vane 6*a* of the rotor 6 having the check valve 19 is equipped with a purge path 24. The purge path 24 communicates between the retardation side hydraulic chamber 10 and the backward pressurized section 14*a* in the accommodation hole 14 as shown in FIG. 6 to FIG. 9B. An opening, which is close to a drain, of the purge path 24 is connected to the backward pressurized section 14*a* in the accommodation hole 14 by way of an inner peripheral wall of the accommodation hole 14. The opening of the purge path 24 is formed at a position where allows the opening being blocked with a peripheral wall of the locking pin 15 in an unlocked state, and where allows the opening being released from such a blocking in a locked state. Moreover, with the embodiment 1, the discharge hole 17, which is arranged in the accommodation hole 14, also serves as a drain path communicating between the purge path 24 and the atmosphere.

With the valve timing control device providing with the check valve 19, each oil path has different parameters such as resistance produced in the oil path and length of the oil path. In this way, a hydraulic pressure, which is applied to the retardation side hydraulic chamber 10 on starting the engine, is supplied to the purge path 24 and the check valve 19 in sequence. An opening are of the purge path 24 is set to be equal to or be larger than those of the first unlocking hydraulic pressure supply path 20 communicating to the check valve 19, the second unlocking hydraulic pressure supply path 21 and the retardation side partitioned pressure path 23. In this way, resistance produced in the purge path 24 can be set to be equal to or be relatively smaller than that of another paths. Moreover, length of the purge path 24 is set to be equal to or be shorter than that of the retardation side partitioned pressure path 23 of the check valve 19. In this way, the direct supply of the hydraulic pressure from the retardation side hydraulic chamber 10 to the purge path can be simultaneous with or be earlier than the indirect supply of the hydraulic pressure from the chamber 10 thereto by way of the check valve 19. Such a parameter is set as appropriate and accordingly it is possible to control the sequence of supplying the hydraulic pressure to the purge path.

In order to keep the hydraulic pressure in the retardation side hydraulic chamber 10, the opening area of the purge path 24 is set to be equal to or be narrower than that of the second oil path 12. The second oil path 12 supplies a hydraulic pressure to the retardation side hydraulic chamber 10 and discharges the hydraulic pressure therefrom. Moreover, the opening area of the purge path 24 is set to be equal to or be larger than that of the discharge hole 17 formed in the accommodation hole 14. In this way, it is possible to produce the residual pressure in the backward pressurized section 14*a* in the accommodation hole 14 using the hydraulic pressure supplied from the purge path 24.

Here, a relation of the opening areas of the oil paths is arranged systematically and is explained using the following inequality: the opening area of the second oil path 12 defined as the pressurized chamber supply path≧that of the purge path 24≧that of the discharge hole 17 served as the drain path≧that of the first unlocking partitioned pressure path 20 or the second unlocking partitioned pressure path 21 defined as the unlocking hydraulic pressure supply path.

An unlocking operation will be explained hereafter. Moreover, with the embodiment 1, the hydraulic chamber allowing the entry of hydraulic pressure on starting the engine is set to be the retardation side hydraulic chamber 10. When the rotor 6 as the second rotor locates at the most retarded position with respect to the first rotor 1 on stopping the engine, the locking pin 15 engages in the engagement hole 18 due to the biasing force of the biasing means 16. As a result, the locking pin 15 is adjusted to lock the first rotor 1 and the second rotor to restrict the free rotation thereof.

First, as shown in FIG. 9A, on starting the engine, a hydraulic pressure derived from the oil pump (not shown) is supplied mainly through the second oil path 12 to the retardation side hydraulic chamber 10. The retardation side hydraulic chamber 10 communicates to both of the unlocking hydraulic chamber 18*a* and the backward pressurized section 14*a* in the accommodation hole 14 in the locked state. The hydraulic pressure (hereafter, referred as a retardation side hydraulic pressure) is supplied to the purge path 24 and the check valve 19 in sequence due to the difference in respect with the resistance produced in the oil path and the length of the oil path as described above. A hydraulic pressure mixing with residual air in the retardation side hydraulic chamber 10 and pipes on its way thereto is therefore applied to the backward pressurized section 14*a* in the accommodation hole 14 byway of the purge path 24. In this way, air mixed in the oil is discharged from the discharge hole 17 to outside of the device by way of the backward pressurized section 14*a*. Moreover, with the embodiment 1, the opening area of the discharge hole 17 is set to be narrower than that of the purge path 24 in order to increase resistance produced in the discharge hole 17. Therefore, it is possible to produce a residual pressure in the backward pressurized section 14*a* in the accommodation hole 14 due to air-released oil. The residual pressure exerts on a back section of the locking pin 15 in the same direction as the biasing force of the biasing means 16.

At the same time, the retardation side hydraulic pressure is supplied to the engagement hole 18 by way of the retardation side partitioned pressure path 23, the check valve 19, the first unlocking hydraulic pressure supply path 20 and the second unlocking hydraulic pressure supply path 21. An unlocking hydraulic pressure is supplied to the unlocking hydraulic chamber 18*a* formed at a boundary between the inner wall of the engagement hole 18 and the outer wall of the locking pin 15. The unlocking hydraulic pressure exerts on the front end of the locking pin 15 against the sum of the biasing force of the biasing means 16 and the residual pressure produced in the backward pressurized section 14*a* in the accommodation hole 14. As a result, the locking pin 15 is pressed in a direction of unlocking the locking relation (refer to A in FIG. 10).

Here, the retardation side hydraulic pressure is defined as Pr, and the residual pressure produced in the backward pressurized section 14*a* in the accommodation hole 14 is defined as P1. An area of the front, circular-shaped section of the locking pin 15 is defined as S, and the biasing force of the biasing means 16 is defined as F. In a state of engagement of the locking pin with the engagement hole, that is, a locked state, an inequality $S(Pr-P1)<F$ is established.

Moreover, the residual pressure P1 is determined by resistance R1 produced in the purge path 24 communicating the retardation side hydraulic chamber 10 and the accommodation hole 14 and resistance R2 produced in the discharge hole 17 communicating between the accommodation hole 14 to the atmosphere. For example, when the resistance R1 of the purge path 24 and the resistance R2 of the discharge hole 17 satisfy an inequality $R1<<R2$, the residual pressure P1 is increased to raise the retardation side unlocking hydraulic pressure. Conversely, when the resistance R1 of the purge path 24 and the resistance R2 of the discharge hole 17 satisfy an inequality $R1>>R2$, the residual pressure P1 becomes small to reduce the retardation side unlocking hydraulic pressure. Here, when the resistance R1 of the purge path 24 is not equal to zero, an inequality $P1<Pr$ is established. In the process of raising the retardation side hydraulic pressure Pr, the inequality is turned to satisfy the following inequality:

$$S(Pr-P1)>F$$

When the retardation side hydraulic pressure Pr is further raised, the locking pin 15 starts moving back (refer to B of FIG. 10). The residual pressure in the backward pressurized section 14*a* of the accommodation hole 14 is discharged quickly to outside of the backward pressurized section 14*a* through the purge path 24 and the discharge hole 17 as the locking pin 15 moves back due to the retardation side hydraulic pressure Pr. Finally, the locking pin 15 is released fully from the engagement hole 18 to finish the unlocking operation (refer to point C of FIG. 10). In this way, it is possible to allow the free rotation of the first rotor 1 and the second rotor. Moreover, due to the unlocking operation, as shown in FIG. 9B, the opening, which is close to a drain, of the purge path 24 is blocked with the outer periphery of the locking pin 15 moving back in the accommodation hole 14. In this way, in the unlocked state, the communication between the retardation side hydraulic chamber 10 and the backward pressurized section 14*a* in the accommodation hole 14 is blocked and accordingly the supply of hydraulic pressure derived from the retardation side hydraulic chamber 10 is cut off. As a result, it is possible to prevent the residual pressure from being produced in the backward pressurized section 14*a*. A pressure keeping the unlocked state or an unlocking-keeping hydraulic pressure based on the retardation side hydraulic pressure Pr must have magnitude adequate for competing against the biasing force of the biasing means 16. In this way, it is possible to limit the unlocking-keeping hydraulic pressure smaller than the unlocking hydraulic pressure (refer to point D of FIG. 10). It is possible to ensure the unlocked state at the low hydraulic pressure.

Next, in a state of not unlocking the locking pin 15, with reference to any operating conditions, an OCV (oil control valve, not shown) is controlled to switch the hydraulic pressure derived from the oil pump (not shown) to the advance side hydraulic chamber 9. At this time, the advance side hydraulic chamber 9 communicates to only the unlocking hydraulic chamber 18*a* byway of the advance side partitioned pressure path 22, the first unlocking hydraulic pressure supply path 20 and the second unlocking hydraulic pressure supply path 21. In contrast to the application of the retardation side hydraulic pressure Pr, the advance side hydraulic chamber 9 does not communicate to the backward pressurized section 14*a* in the accommodation hole 14. Therefore, a hydraulic pressure (hereafter, referred as advance side hydraulic pressure Pa) applied to the advance side hydraulic chamber 9 exerts only on the front end of the locking pin 15 in the unlocking hydraulic chamber 18*a* as in the case of the application of the retardation side hydraulic pressure Pr. In the process of raising the advance side hydraulic pressure Pa, the pressure Pa becomes a hydraulic pressure (unlocking hydraulic pressure) adequate for competing against only the biasing force of the biasing means 16. That is, when the advance side hydraulic pressure Pa satisfies an inequality $SPa>F$, the locking pin 15 starts moving back. The residual pressure in the backward pressurized section 14*a* of the accommodation hole 14 is discharged quickly to outside of the backward pressurized section 14*a* through the purge path 24 and the discharge hole 17 as the locking pin 15 moves back due to the advanced side hydraulic pressure Pa. The unlocking hydraulic pressure exerted area on application of the retardation side hydraulic pressure Pr is the same as the pressure-exerted area on application of the advance side hydraulic pressure Pa. Therefore, it is possible to unlock the locking pin 15 at a hydraulic pressure smaller than the unlocking hydraulic pressure based on the retardation side hydraulic pressure Pr by the residual pressure. Thus, the unlocking hydraulic characteristics on the application of the advance side hydraulic pressure Pa exhibits as in the case of the conventional one exhibiting no hysteresis as illustrated in FIG. 5. Finally, the locking pin 15 is released fully from the engagement hole 18 to finish the unlocking operation. In this way, it is possible to allow the free rotation of the first rotor 1 and the second rotor.

Moreover, due to the unlocking operation, as shown in FIG. 9B, the opening, which is close to a drain, of the purge path 24 is blocked with the outer periphery of the locking pin 15 moving back in the accommodation hole 14. In this way, in the unlocked state, the communication between the retardation side hydraulic chamber 10 and the backward pressurized section 14*a* in the accommodation hole 14 is blocked and accordingly the supply of hydraulic pressure derived from the retardation side hydraulic chamber 10 is cut off. As a result, it is possible to prevent the residual pressure from being produced in the backward pressurized section 14*a*. A pressure keeping the unlocked state or an unlocking-keeping hydraulic pressure must have magnitude adequate for competing against the biasing force of the biasing means 16. In this way, it is possible to limit the unlocking-keeping hydraulic pressure smaller than the unlocking hydraulic pressure (refer to point D of FIG. 10). Even if the application of the advance side hydraulic pressure is then switched again to that of the retardation side hydraulic pressure, it is possible to ensure the unlocked state at a low hydraulic pressure when the locking relation is unlocked at one time.

A locking operation will be explained hereafter.

When the engine is stopped, the oil pump (not shown) is also stopped. The oil in the valve timing control device therefore comes down to the oil pan (not shown). The hydraulic pressure in the engagement hole 18 is reduced, and the locking pin 15 moves forward due to the biasing force of the biasing means 16 to engage in the unlocking hydraulic chamber 18*a* (refer to point E of FIG. 10).

As described above, with the embodiment 1, the purge path 24 communicating to the retardation side hydraulic chamber 10 is disposed at the backward pressurized section 14*a* in the accommodation hole 14 functioned as the backward pressurized chamber for the locking member. In this way, the hydraulic pressure applied to the backward pressurized section 14*a* by way of the purge path 24 can produce the residual pressure in the backward pressurized section 14*a*. Both of the residual pressure and the biasing force of the biasing means 16 exert on the back section of the locking pin 15 in the same direction. On the other hand, the retardation side hydraulic pressure Pr is supplied to the unlocking hydraulic chamber 18*a* by way of the check valve 19 and so on and exerts on the front end of the locking pin 15. When the locking relation is unlocked on application of the retardation side hydraulic pressure Pr, it is necessary to produce a hydraulic pressure which competes against the sum of the residual pressure and the biasing force of the biasing means 16. The unlocking operation is therefore delayed. It is possible to delay the unlocking operation until the applied hydraulic pressure reaches a level of allowing the control of the valve timing control device. Therefore, it is possible to prevent the locking relation from being unlocked accidentally before a hydraulic pressure adequately rises on starting the engine and so on and to prevent the occurrence of the beat noise (abnormal noise) with reliability.

With the embodiment 1, The opening, which is close to the drain, of the purge path 24 is blocked with the outer periphery of the locking pin 15 in the unlocked state. The opening, which is close to the drain, of the purge path 24 is released from the blocking of the locking pin 15 in the locked state. Therefore, it is possible to produce the residual pressure, which exerts on the locking pin 15 in the same direction as the biasing force of the biasing means 16, in the backward pressurized section 14*a* in the accommodation hole 14 using the retardation side hydraulic pressure Pr on locking. No residual pressure is produced due to the advance side hydraulic pressure Pa or the retardation side hydraulic pressure Pr on unlocking. In this way, when the retardation side hydraulic pressure Pr is applied in the locked state, it is possible to produce a pressure difference between the unlocking hydraulic pressure which exerts on the locking pin 15 against the sum of the residual pressure and the biasing force of the biasing means 16 and the unlocking-keeping hydraulic pressure adequate for competing against only the biasing force of the biasing means 16. Therefore, it is possible to set the unlocking hydraulic characteristic exhibiting hysteresis of satisfying the relation of the hydraulic pressure above as illustrated in FIG. 10. Thus, since the unlocking hydraulic characteristic exhibits the hysteresis, it is possible to delay the unlocking operation due to the retardation side hydraulic pressure Pr. After the unlocking operation is finished, it is possible to keep the unlocking hydraulic pressure at a low hydraulic pressure. It is possible to keep a relative, rotational state of the first rotor 1 and the second rotor at all times under operating conditions without loss of control characteristic of the valve timing control device.

With the embodiment 1, in order to produce a pressure difference between the unlocking hydraulic pressure and the unlocking-keeping hydraulic pressure and to establish the unlocking hydraulic characteristics exhibiting the hysteresis, a throttle for narrowing partially the opening area of oil paths may be formed. Furthermore, the throttles may be adjusted in consideration of the distribution of resistance produced in oil paths. In this case, since a resistance difference between throttle-equipped oil paths and no throttle-equipped oil paths is produced, it is possible to delay the sequence of supplying the hydraulic pressure to the throttle-equipped oil paths. In this way, it is possible to adjust the throttle in the oil paths as appropriate in order to direct the unlocking hydraulic pressure toward the purge path 24 having precedence over toward the unlocking hydraulic chamber 18*a*. Alternatively, the biasing force of the biasing means 16 may be adjusted in order to produce a pressure difference between the unlocking hydraulic pressure and the unlocking-keeping hydraulic pressure and to establish the unlocking hydraulic characteristics exhibiting the hysteresis.

With the embodiment 1, the purge path 24 is so arranged as to communicate between the retardation side hydraulic chamber 10 and the backward pressurized section 14*a* in the accommodation hole 14 functioned as the backward pressurized chamber for the locking pin 15. Alternatively, a purge path may be arranged as to communicate between oil paths allowing the supply of the hydraulic pressure from the retardation side hydraulic chamber 10 and the backward pressurized section 14*a* in the accommodation hole 14. The oil paths include the retardation side partitioned pressure path 23 communicating to the check valve 19, the first unlocking hydraulic pressure supply path 20 or the second unlocking hydraulic pressure supply path 21.

With the embodiment 1, when the rotor 6 defined as the second rotor locates at the most retarded position with respect to the first rotor 1 on stopping the engine, the locking pin 15 is set to engage in the engagement hole 18 due to the biasing force of the biasing means 16 to restrict the free rotation of the first and second rotors. Alternatively, the locking pin 15 may be set to engage in the engagement hole 18 formed at a position other than the most retarded position. When the engagement hole 18 is formed at the most advanced position, the purge path may be arranged to communicate between the advance side hydraulic chamber 9 and the backward pressurized section 14*a* in the accommodation hole 14. Alternatively, the purge path may be arranged to communicate between oil paths allowing the supply of the hydraulic pressure from the advance side hydraulic chamber 9 and the backward pressurized section 14*a* in the accommodation hole 14. The oil paths include the advance side partitioned pressure path 22 communicating to the check valve 19, the first unlocking hydraulic pressure supply path 20 or the second unlocking hydraulic pressure supply path 21.

With the embodiment 1, a single purge path 24 communicating between the retardation side hydraulic chamber 10 and the backward pressurized section 14*a* in the accommodation hole 14 equipped with the discharge hole 17 is arranged. Alternatively, at least one purge path may be arranged to communicate any one of the advance side hydraulic chamber 9, the retardation side hydraulic chamber 10, the advance or retardation side partitioned pressure path 22 or 23 each communicating to the check valve 19, the first or second unlocking hydraulic pressure supply path 20 or 21 to the atmosphere. In this case, since air or air-mixed oil used in first motion of the unlocking operation on starting the engine can be discharged positively to outside, it is possible to unlock the locking relation after the applied hydraulic pressure reaches a level of allowing the control of the valve timing control device.

With the embodiment 1, the discharge hole 17 serves as a drain path. Alternatively, a different drain path communicating between the purge path 24 and the atmosphere may be arranged at the accommodation hole 14. As in the case of the discharge hole 17, an opening area of the drain path is smaller than that of the purge path 24 or a throttle for narrowing the opening area of the drain path may be formed therein. In this way, resistance of the drain path is raised as compared with the purge path 24 to produce a residual pressure in the backward pressurized section 14*a* in the accommodation hole 14. It is possible to delay the unlocking operation and to prevent the occurrence of beat noise (abnormal noise).

With the embodiment 1, the hydraulic chamber allowing the entry of hydraulic pressure on starting the engine is set to be the retardation side hydraulic chamber 10. Alternatively, the hydraulic chamber allowing the entry of hydraulic pressure on starting the engine may be set to be the advance side hydraulic chamber 9. In this case, the first and second rotors may be locked at a position other than the most retarded position, including the most advanced position or a middle position defined between the most retarded position and the most advanced position, for example.

Embodiment 2

Figure 11:
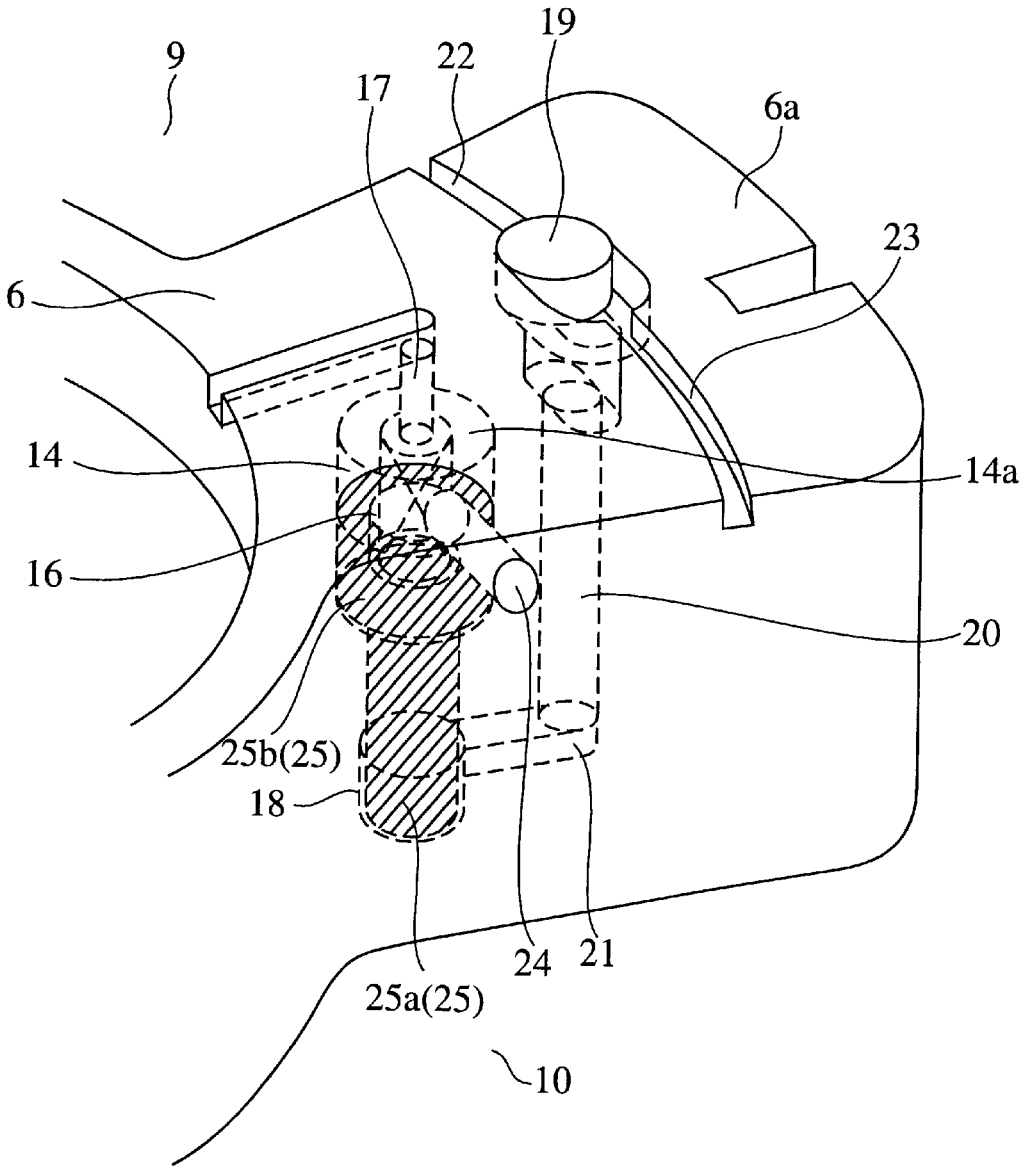
FIG. 11 is a perspective view of an important part of a locking/unlocking mechanism of a valve timing control device as embodiment 2 according to the present invention.
Figure 12A:
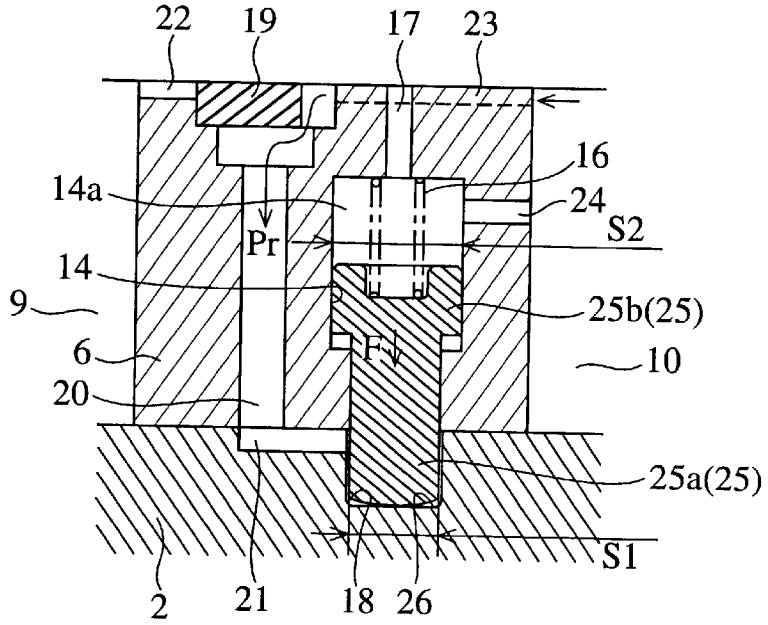
FIG. 12A and FIG. 12B are longitudinal cross sectional views of an operation of the locking/unlocking mechanism of the valve timing control device shown in FIG. 11.
Figure 12B:
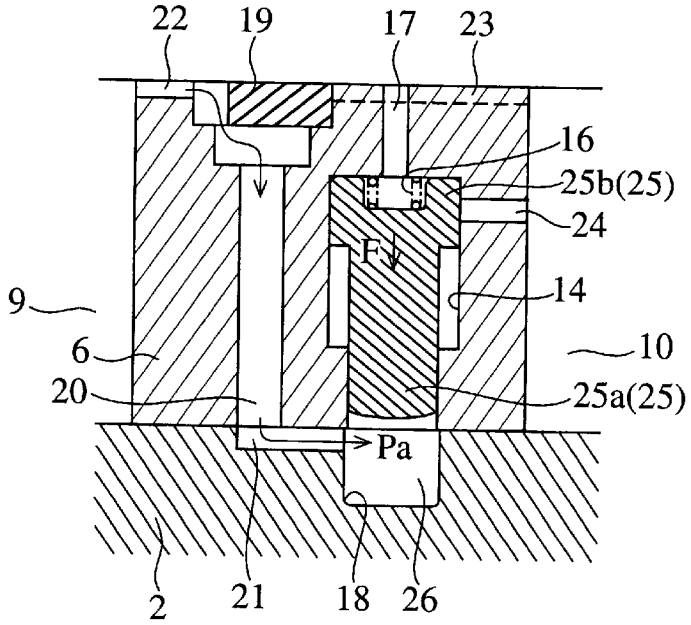
Figure 13:
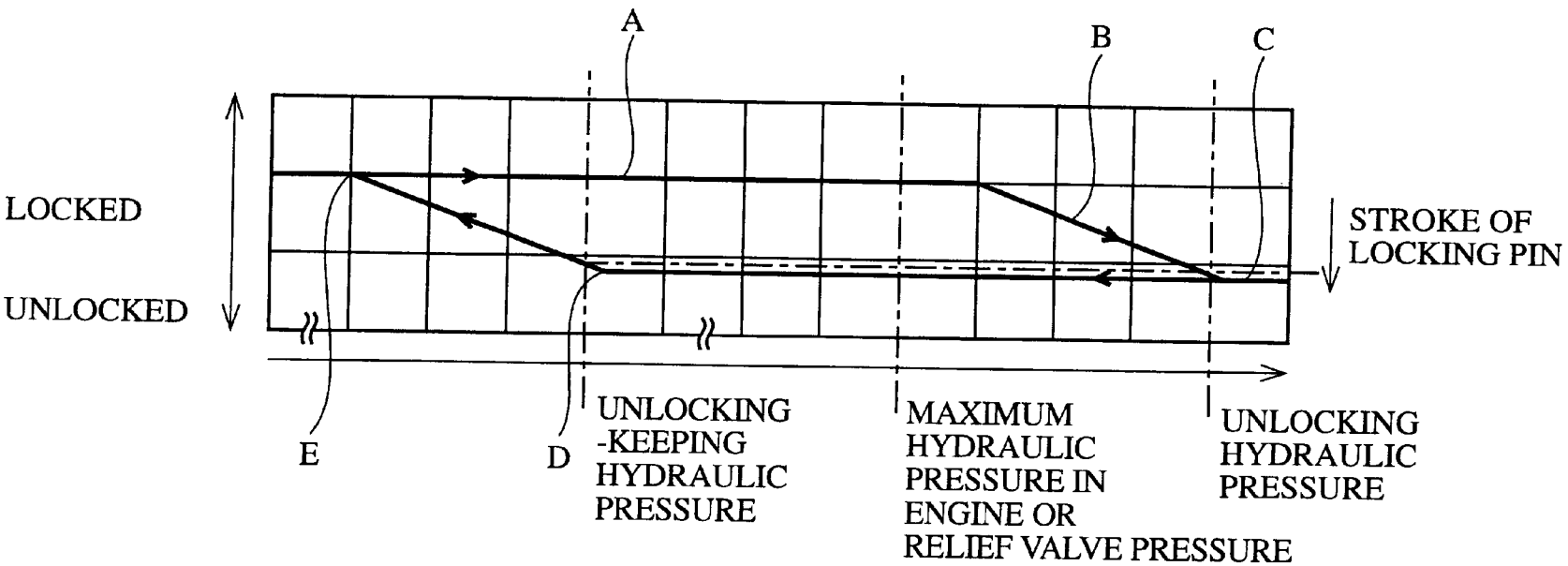
FIG. 13 is a graph of a relation ship between an operational stroke of a locking member of the locking mechanism of the valve timing control device illustrated in FIG. 11 to FIG. 12B and a hydraulic pressure exerted on the locking member.

FIG. 11 is a perspective view of an important part of a locking/unlocking mechanism of a valve timing control device as embodiment 2 according to the present invention. FIG. 12A and FIG. 12B are longitudinal cross sectional views of an operation of the locking/unlocking mechanism of the valve timing control device shown in FIG. 11, FIG. 12A shows a locked state and FIG. 12B shows an unlocked state. FIG. 13 is a graph of a relation ship between an operational stroke of a locking member of the locking-mechanism of the valve timing control device illustrated in FIG. 11 to FIG. 12B and a hydraulic pressure exerted on the locking member. Components of the embodiment 2 common to those of the conventional valve timing control device shown in FIG. 1 to FIG. 5 or those of the embodiment 1 are denoted by the same reference numerals and further description will be omitted.

The embodiment 2 is characterized in that a locking pin 25 defined as the tier-equipped pin is used, whereas the straight-shaped locking pin 15 defined as the locking member having a constant diameter and mach inability superior to the tier-equipped pin is used in the embodiment 1. The locking pin 25 includes a minor diameter section 25*a* arranged at a front end thereof, and a major diameter section 25*b* having an outer diameter larger than an outer diameter of the minor diameter section 25*a*. Therefore, with the embodiment 2, the engagement hole 18 has an inner diameter corresponding to the outer diameter of the minor diameter section 25*a*. The accommodation hole 14 has an inner diameter corresponding to the outer diameter of the major diameter section 25*b*. A first unlocking hydraulic chamber 26 is formed between an outer wall of the minor diameter section 25*a* of the locking pin 25 and an inner wall of the engagement hole 18.

Here, as shown in FIG. 12A and FIG. 12B, an area (hereafter, referred as unlocking hydraulic pressure exerted area), on which the unlocking hydraulic pressure is exerted in the first unlocking hydraulic chamber 26, of the minor diameter section 25*a* of the locking pin 25 is defined as S1. An area (hereafter, referred as backward pressure exerted area), on which the backward pressure is exerted in the backward pressurized section 14*a* in the accommodation hole 14, of a back section of the locking pin 25 is defined as S2. An inequality S1<S2 is established at all times.

An unlocking operation will be explained hereafter.

First, on starting the engine, as shown in FIG. 12A, the hydraulic pressure derived from the oil pump (not shown) is supplied mainly through the second oil path 12 to the retardation side hydraulic chamber 10. The retardation side hydraulic chamber 10 communicates to both of the first unlocking hydraulic chamber 26 and the backward pressurized section 14*a* in the accommodation hole 14 in the locked state. The retardation side hydraulic pressure Pr is supplied to the backward pressurized section 14*a* and then to the check valve 19 in the accommodation hole 14 by way of the purge path 24. With the embodiment 2, since the opening area of the discharge hole 17 is narrower than that of the purge path 24 and the resistance produced in the discharge hole 17 is increased as in the case of the embodiment 1. A hydraulic pressure mixing with residual air in the retardation side hydraulic chamber 10 and pipes on its way thereto is therefore applied to the backward pressurized section 14*a* in the accommodation hole 14 by way of the purge path 24. In this way, air mixed in the oil is discharged from the discharge hole 17 to outside of the device by way of the backward pressurized section 14*a*. Moreover, with the embodiment 2, as in the case of the embodiment 1, the opening area of the discharge hole 17 is set to be narrower than that of the purge path 24 in order to increase resistance produced in the discharge hole 17. Therefore, it is possible to produce a residual pressure in the backward pressurized section 14*a* in the accommodation hole 14 due to air-released oil. The residual pressure exerts on a back section of the locking pin 25 in the same direction as the biasing force of the biasing means 16.

At the same time, the retardation side hydraulic pressure Pr is supplied to the first unlocking hydraulic chamber 26 by way of the retardation side partitioned pressure path 23, the check valve 19, the first unlocking hydraulic pressure supply path 20 and the second unlocking hydraulic pressure supply path 21. An unlocking hydraulic pressure supplied to the first unlocking hydraulic chamber 26 exerts on the front end of the locking pin 15 against the sum of the biasing force of the biasing means 16 and the residual pressure produced in the backward pressurized section 14*a* in the accommodation hole 14. As a result, the locking pin 15 is pressed in a direction of unlocking the locking relation (refer to A of FIG. 13).

Here, the residual pressure produced in the backward pressurized section 14*a* is defined as P1 and the biasing force of the biasing means 16 is defined as F. When the following inequality $$S1Pr-S2P1<F$$

is established, the locking relation is not unlocked to keep the locked state. Here, since an inequality S1<S2 is established at all times, the left side of the inequality above is zero or less when Pr is nearly equal to P1. Therefore, even if the retardation side hydraulic pressure Pr is raised further to the maximum hydraulic pressure in the engine or the relief valve hydraulic pressure as shown in FIG. 13, it is impossible to unlock the locking relation due to the retardation side hydraulic pressure Pr.

Next, in the locked state, with reference to any operating conditions, an OCV (oil control valve, not shown) is controlled to switch the hydraulic pressure derived from the oil pump (not shown) to the advance side hydraulic chamber 9. At this time, the advance side hydraulic chamber 9 communicates to only the first unlocking hydraulic chamber 26 by way of the advance side partitioned pressure path 22, the check valve 19, the first and second unlocking hydraulic pressure supply paths 20 and 21 as shown in FIG. 12B. In contrast to the application of the retardation side hydraulic pressure Pr, the advance side hydraulic chamber 9 does not communicate to the backward pressurized section 14*a* in the accommodation hole 14. Therefore, the advance And side hydraulic pressure Pa exerts only on the front end of the locking pin 25 in the first unlocking hydraulic chamber 26. In the process of raising the advance side hydraulic pressure Pa, the pressure Pa becomes a hydraulic pressure (unlocking hydraulic pressure) against the biasing force of the biasing means 16. That is, when the advance side hydraulic pressure Pa satisfies an inequality $$S1Pa>F,$$

the locking pin 25 starts moving back. The residual oil in the backward pressurized section 14*a* of the accommodation hole 14 is discharged quickly to outside of the backward pressurized section 14*a* through the purge path 24 and the discharge hole 17 as the locking pin 25 moves back due to the advance side hydraulic pressure Pa. Therefore, it is possible to unlock the locking pin 25 at a hydraulic pressure smaller than the unlocking hydraulic pressure based on the retardation side hydraulic pressure Pr by the residual pressure. Thus, the unlocking hydraulic characteristics on the application of the advance side hydraulic pressure Pa exhibits as in the case of the conventional one exhibiting no hysteresis as illustrated in FIG. 5. Finally, the locking pin 25 is released fully from the engagement hole 18 to finish the unlocking operation. In this way, it is possible to allow the free rotation of the first rotor 1 and the second rotor.

Moreover, due to the unlocking operation, as shown in FIG. 12B, the opening, which is close to a drain, of the purge path 24 is blocked with the outer periphery of the major diameter section 25*b* of the locking pin 25 moving back in the accommodation hole 14. In this way, in the unlocked state, the communication between the retardation side hydraulic chamber 10 and the backward pressurized section 14*a* in the accommodation hole 14 is blocked and accordingly the supply of hydraulic pressure derived from the retardation side hydraulic chamber 10 to the backward pressurized section 14*a* is cut off. As a result, it is possible to prevent the residual pressure from being produced in the backward pressurized section 14*a*. The unlocking-keeping hydraulic pressure has magnitude adequate for competing against only the biasing force of the biasing means 16. In this way, it is possible to limit the unlocking-keeping hydraulic pressure smaller than the unlocking hydraulic pressure. Even if the application of the advance side hydraulic pressure is then switched again to that of the retardation side hydraulic pressure, it is possible to ensure the unlocked state at a low hydraulic pressure when the locking relation is unlocked at one time.

A locking operation will be explained hereafter.

When the engine is stopped, the oil pump (not shown) is also stopped. The oil in the valve timing control device therefore comes down to the oil pan (not shown). The hydraulic pressure in a first unlocking hydraulic chamber 26 is reduced, and the locking pin 25 moves forward due to the biasing force of the biasing means 16 to engage in the engagement hole 18 (refer to point E of FIG. 13). At this time, the locking operation is finished.

As described above, with the embodiment 2, the tier-equipped pin defined as the locking member is used and the purge path 24 communicating between the backward pressurized section 14*a* in the accommodation hole 14 and the retardation side hydraulic chamber 10 is arranged, in contrast to the embodiment 1. In this way, it is possible to prevent substantially the locking relation from being unlocked on the application of the retardation side hydraulic pressure Pr. Therefore, it is possible to prevent the locking relation from being unlocked accidentally before a hydraulic pressure adequately rises on starting the engine and so on and to prevent the occurrence of the beat noise (abnormal noise) with reliability. When the advance side hydraulic pressure is switched from the retardation side hydraulic pressure Pr after the hydraulic pressure reaches a level of allowing the control of the valve timing control device, it is possible to unlock the locking relation due to the advance side hydraulic pressure Pa for the first time.

With the embodiment 2, the backward pressure exerted area S2 is larger than the unlocking hydraulic pressure exerted area S1. Even if the residual pressure is limited to a low value, it is impossible to unlock the locking relation due to the retardation side hydraulic pressure Pr. The biasing force of the biasing means and the distribution of resistance produced in oil paths may be therefore set as distinct from the embodiment 1. Since the unlocking-keeping hydraulic pressure can be set to be smaller than the unlocking hydraulic pressure, for example, as for the biasing force of the biasing means 16, the embodiment 2 may be set to be smaller than the embodiment 1. Moreover, the enlarged opening area of the discharge hole 17 or the drain path (not shown) allows the control of the backward pressurized section 14*a* to atmospheric pressure in order to facilitate release of air. As a result, it is possible to improve ease of insertion of the locking pin 25 into the engagement hole 18 on stopping the engine. Moreover, the down sized opening area of the purge path 24 can lead to the reduction of the residual pressure produced in the backward pressurized section 14*a* and can restrict the amount of oil discharged to outside of the device.

With the embodiment 2, the unlocking hydraulic pressure exerted area S1 is distinct from the backward pressure exerted area S2. Therefore, the setting of the ratio of the unlocking hydraulic pressure exerted area S1 and the backward pressure exerted area S2 may be defined as a choice for setting an unlocking hydraulic characteristic having hysteresis required, in addition to the setting of the distribution of resistance produced in oil paths or the biasing force of the biasing means 16.

Embodiment 3

Figure 14:
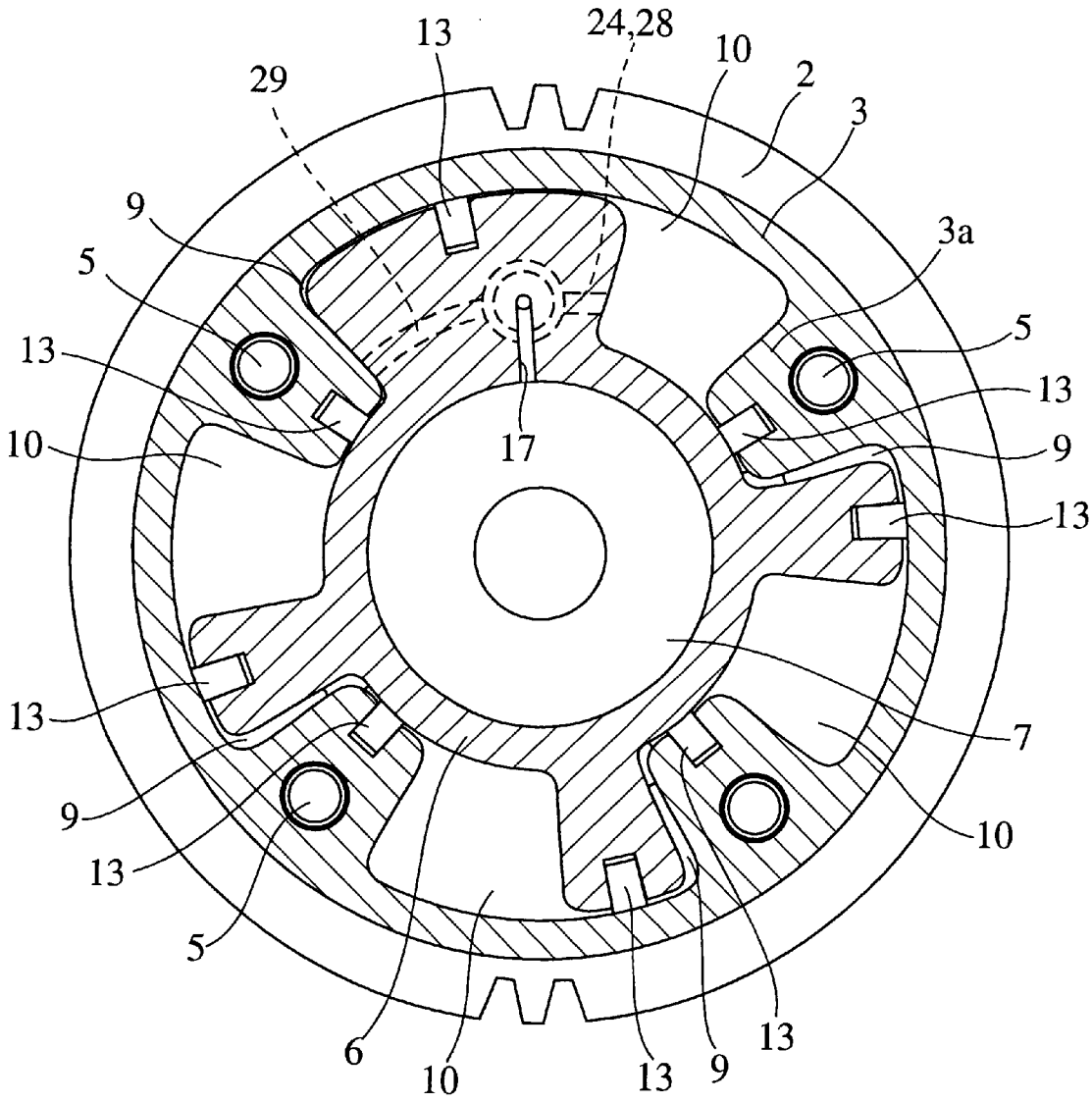
FIG. 14 is a lateral cross sectional view of an internal construction of a valve timing control device as embodiment 3 according to the present invention.
Figure 15:
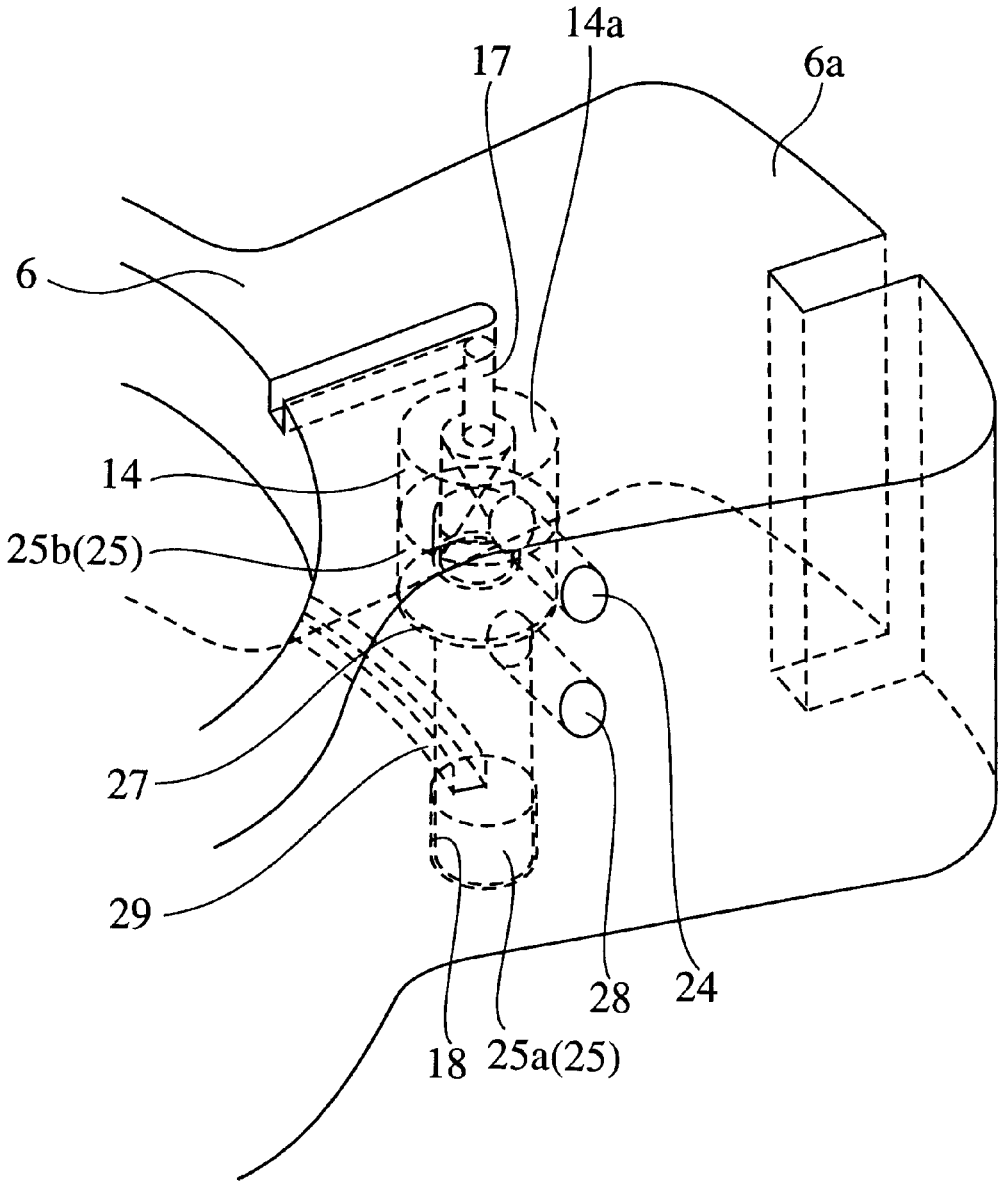
FIG. 15 is a perspective view of an important part of a locking/unlocking mechanism of the valve timing control device shown in FIG. 14.
Figure 16A:
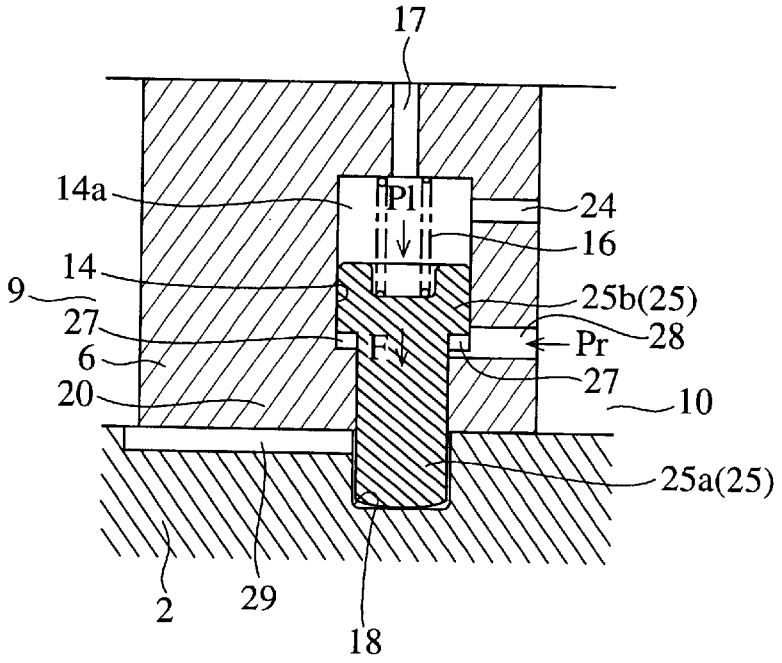
FIG. 16A and FIG. 16B are longitudinal cross sectional views of an operation of the locking/unlocking mechanism of the valve timing control device shown in FIG. 14 and FIG. 15.
Figure 16B:
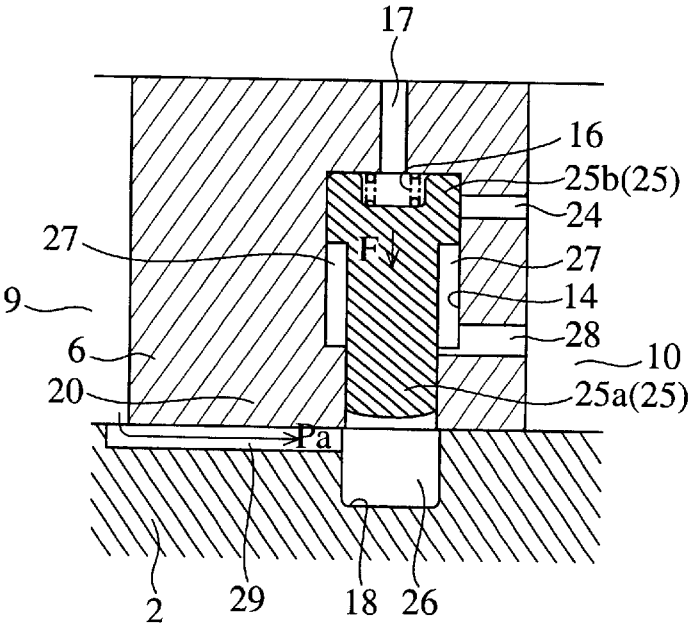

FIG. 14 is a lateral cross sectional view of an internal construction of a valve timing control device as embodiment 3 according to the present invention. FIG. 15 is a perspective view of an important part of a locking/unlocking mechanism of the valve timing control device shown in FIG. 14. FIG. 16A and FIG. 16B are longitudinal cross sectional views of an operation of the locking/unlocking mechanism of the valve timing control device shown in FIG. 14 and FIG. 15, FIG. 16A shows a locked state and FIG. 16B shows an unlocked state. Components of the embodiment 3 common to those of the conventional valve timing control device shown in FIG. 1 to FIG. 5 or those of the embodiment 1 are denoted by the same reference numerals and further description will be omitted.

With the embodiment 3, a third unlocking hydraulic pressure supply path 28 is disposed at the vane 6*a* of the rotor 6 and a fourth unlocking hydraulic pressure supply paths 29 is disposed at the sprocket 2, instead of the check valve 19 used in the embodiment 1 and the embodiment 2. The third unlocking hydraulic pressure supply path 28 communicates between a second unlocking hydraulic chamber 27, which is formed between the front end of the major diameter section 25*b* of the locking pin 25 and the inner wall of the accommodation hole 14, and the retardation side hydraulic chamber 10. The fourth unlocking hydraulic pressure supply path 29 communicates between the first unlocking hydraulic chamber 26 and the advance side hydraulic chamber 9.

An unlocking operation will be explained hereafter.

First, as shown in FIG. 16A, on starting the engine, a hydraulic pressure derived from the oil pump (not shown) is supplied mainly through the second oil path 12 to the retardation side hydraulic chamber 10. The retardation side hydraulic chamber 10 communicates to both of the second unlocking hydraulic chamber 27 and the backward pressurized section 14*a* in the accommodation hole 14 in the locked state. The retardation side hydraulic pressure Pr is supplied through the purge path 24 to the backward pressurized section 14*a* in the accommodation hole 14. With the embodiment 3, the opening area of the discharge hole 17 is narrower than that of the purge path 24 as in the case of the embodiment 1 and so on. A hydraulic pressure mixing with residual air in the retardation side hydraulic chamber 10 and pipes on its way thereto is therefore applied to the backward pressurized section 14*a* in the accommodation hole 14 by way of the purge path 24. In this way, air mixed in the oil is discharged from the discharge hole 17 to outside of the device by way of the backward pressurized section 14*a*. Moreover, with the embodiment 3, as in the case of the embodiment 1 and so on, the opening area of the discharge hole 17 is set to be narrower than that of the purge path 24 in order to increase resistance produced in the discharge hole 17. Therefore, it is possible to produce a residual pressure in the backward pressurized section 14*a* in the accommodation hole 14 due to air-released oil. The residual pressure exerts on a back section of the locking pin 25 in the same direction as the biasing force of the biasing means 16.

At the same time, the retardation side hydraulic pressure Pr is supplied to the second unlocking hydraulic chamber 27 by way of the third unlocking hydraulic pressure supply path 28. Here, an unlocking hydraulic pressure exerted area of the locking pin 25 in the second unlocking hydraulic chamber 27 is defined as (S2−S1). The residual pressure produced in the backward pressurized section 14*a* is defined as P1 and the biasing force of the biasing means 16 is defined as F. When the following inequality (S2−S1) Pr−S2P1<F is established, the locking relation is not unlocked to keep the locked state. Here, since an inequality $$S1<S2$$

is established at all times, the left side of the inequality above is zero or less when Pr is nearly equal to P1. Therefore, even if the retardation side hydraulic pressure Pr is raised further to the maximum hydraulic pressure in the engine or the relief valve hydraulic pressure, it is impossible to unlock the locking relation.

Next, in the locked state, with reference to any operating conditions, an OCV (oil control valve, not shown) is controlled to switch the hydraulic pressure derived from the oil pump (not shown) to the advance side hydraulic chamber 9. At this time, the advance side hydraulic chamber 9 communicates to only the first unlocking hydraulic chamber 26 by way of the fourth unlocking hydraulic pressure supply paths 29. In contrast to the application of the retardation side hydraulic pressure Pr, the advance side hydraulic chamber 9 does not communicate to the backward pressurized section 14*a* in the accommodation hole 14. Therefore, the advance side hydraulic pressure Pa exerts only on the front end (pressure-exerted area S1) of the locking pin 25 in the first unlocking hydraulic chamber 26. In the process of raising the advance side hydraulic pressure Pa, the pressure Pa becomes a hydraulic pressure (unlocking hydraulic pressure) adequate for competing against the biasing force of the biasing means 16. That is, when the advance side hydraulic pressure Pa satisfies an inequality S1Pa>F, the locking pin 25 starts moving back. The residual oil in the backward pressurized section 14*a* of the accommodation hole 14 is discharged quickly to outside of the backward pressurized section 14*a* through the purge path 24 and the discharge hole 17 as the locking pin 25 moves back due to the advance side hydraulic pressure Pa. Therefore, it is possible to unlock the locking pin 25 at a hydraulic pressure smaller than the unlocking hydraulic pressure based on the retardation side hydraulic pressure Pr by the residual pressure. Thus, the unlocking hydraulic characteristics on the application of the advance side hydraulic pressure Pa exhibits as in the case of the conventional one exhibiting no hysteresis as illustrated in FIG. 5. Finally, the locking pin 25 is released fully from the engagement hole 18 to finish the unlocking operation. In this way, it is possible to allow the free rotation of the first rotor 1 and the second rotor.

Moreover, due to the unlocking operation, as shown in FIG. 16B, the opening, which is close to a drain, of the purge path 24 is blocked with the outer periphery of the major diameter section 25*b* of the locking pin 25 moving back in the accommodation hole 14. In this way, in the unlocked state, the communication between the retardation side hydraulic chamber 10 and the backward pressurized section 14*a* in the accommodation hole 14 is blocked and accordingly the supply of hydraulic pressure derived from the retardation side hydraulic chamber 10 to the backward pressurized section 14*a* is cut off. As a result, it is possible to prevent the residual pressure from producing in the backward pressurized section 14*a*. The unlocking-keeping hydraulic pressure has magnitude adequate for competing against only the biasing force of the biasing means 16. In this way, it is possible to limit the unlocking-keeping hydraulic pressure smaller than the unlocking hydraulic pressure. Even if the application of the advance side hydraulic pressure is then switched again to that of the retardation side hydraulic pressure, it is possible to ensure the unlocked state at a low hydraulic pressure when the locking relation is unlocked at one time.

A locking operation will be explained hereafter.

When the engine is stopped, the oil pump (not shown) is also stopped. The oil in the valve timing control device therefore comes down to the oil pan (not shown). The hydraulic pressure in the first unlocking hydraulic chamber 26 and the second unlocking hydraulic chamber 27 is reduced, and the locking pin 25 moves forward due to the biasing force of the biasing means 16 to engage in the engagement hole 18. At this time, the locking operation is finished.

With the embodiment 3, as in the case of the embodiment 2, the tier-equipped pin defined as the locking member is used and the purge path 24 communicating between the backward pressurized section 14*a* in the accommodation hole 14 and the retardation side hydraulic chamber 10 is arranged. In this way, it is possible to prevent substantially the locking relation from being unlocked on the application of the retardation side hydraulic pressure Pr. Therefore, it is possible to prevent the locking relation from being unlocked accidentally before a hydraulic pressure adequately rises on starting the engine and so on and to prevent the occurrence of the beat noise (abnormal noise) with reliability. When the advance side hydraulic pressure is switched from the retardation side hydraulic pressure Pr after the hydraulic pressure reaches a level of allowing the control of the valve timing control device, it is possible to unlock the locking relation due to the advance side hydraulic pressure Pa for the first time.

With the embodiment 3, the third unlocking hydraulic pressure supply path 28 communicating between the second unlocking hydraulic chamber 27 and the retardation side hydraulic chamber 10 is arranged, in contrast to the embodiment 2. In this way, even when the retardation side hydraulic pressure Pr is applied in the unlocked state, it is possible to ensure the unlocked state due to the retardation side hydraulic pressure Pr.

Embodiment 4

Figure 17:
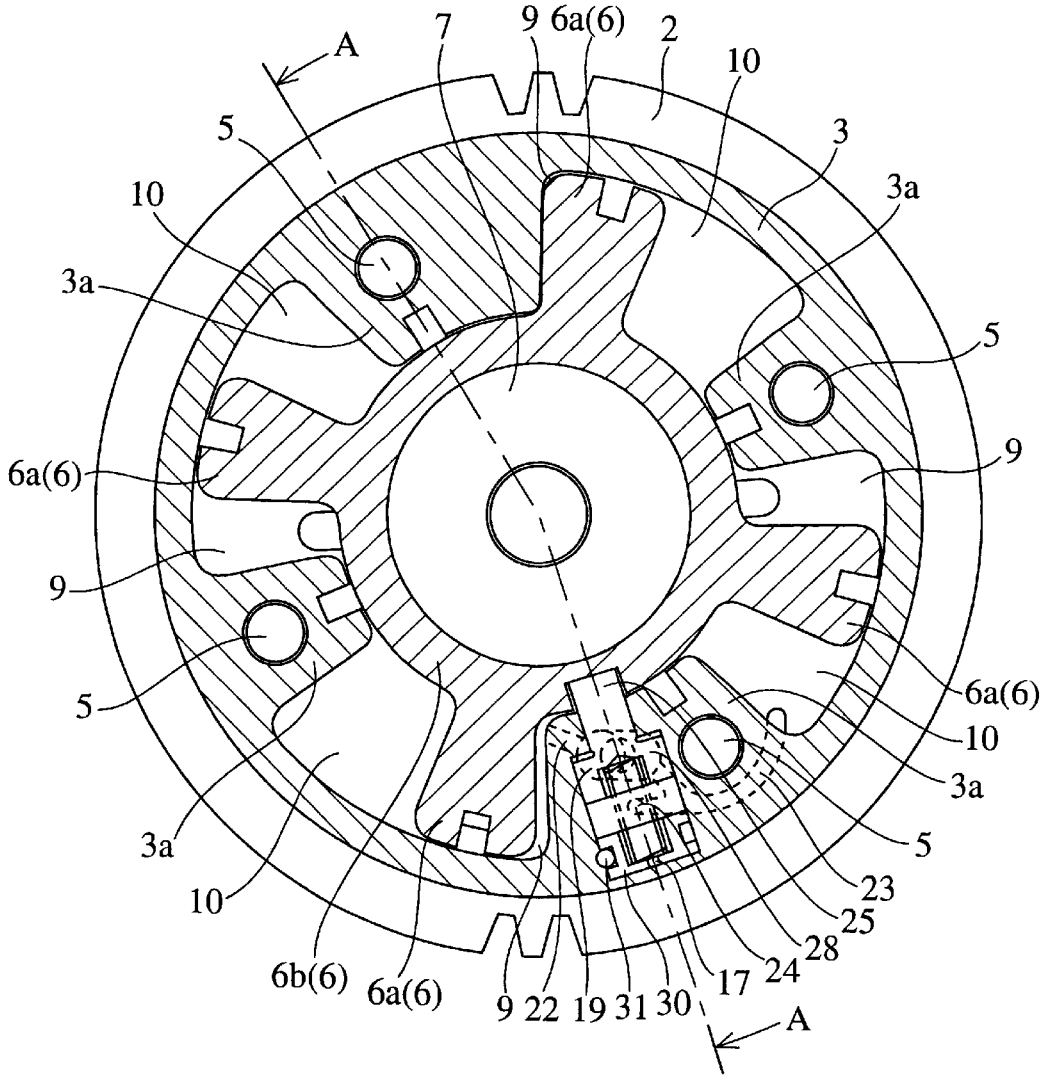
FIG. 17 is a lateral cross sectional view of an internal construction of a valve timing control device as embodiment 4 according to the present invention.
Figure 18:
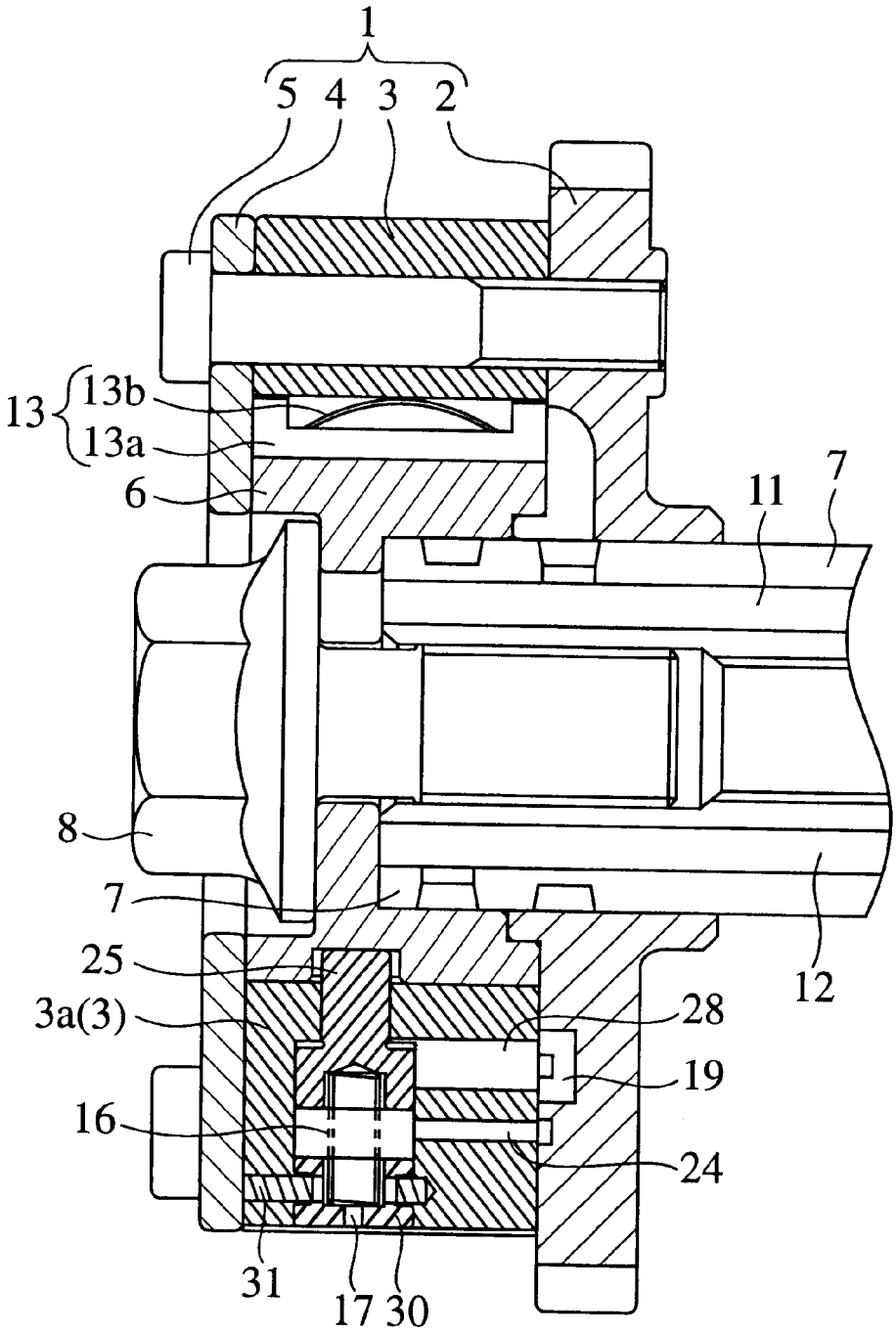
FIG. 18 is a longitudinal cross sectional view taken along lines A—A of FIG. 17.
Figure 19:
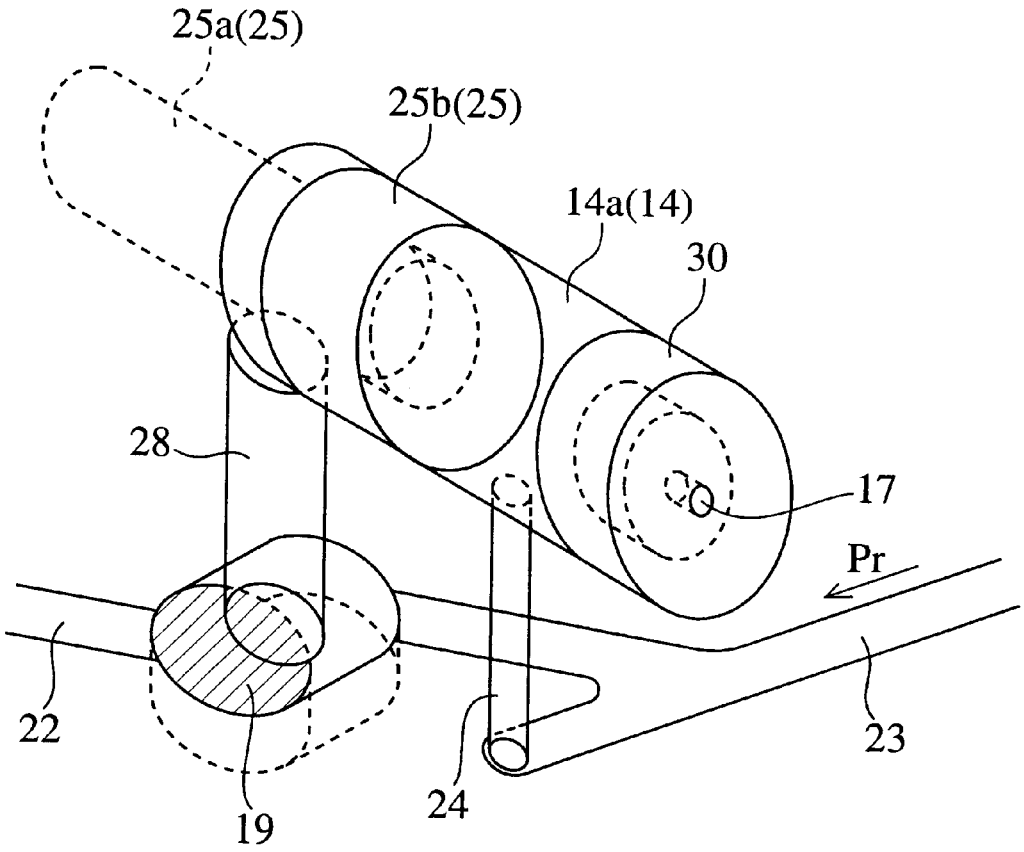
FIG. 19 is an enlarged perspective view of a locking/unlocking mechanism of the valve timing control device shown in FIG. 17 and FIG. 18.
Figure 20A:
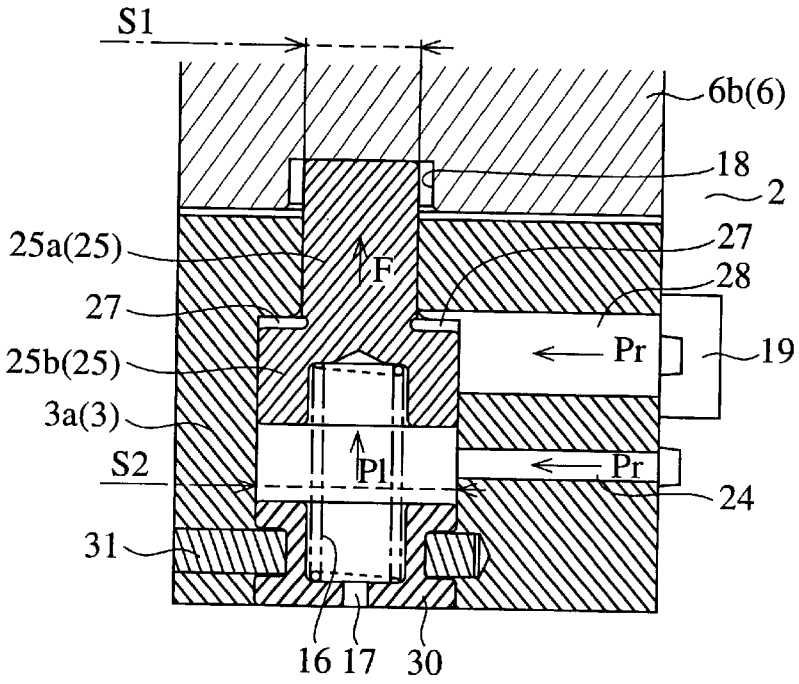
FIG. 20A and FIG. 20B are longitudinal cross sectional views of an operation of the locking/unlocking mechanism of the valve timing control device shown in FIG. 17 to FIG. 19.
Figure 20B:
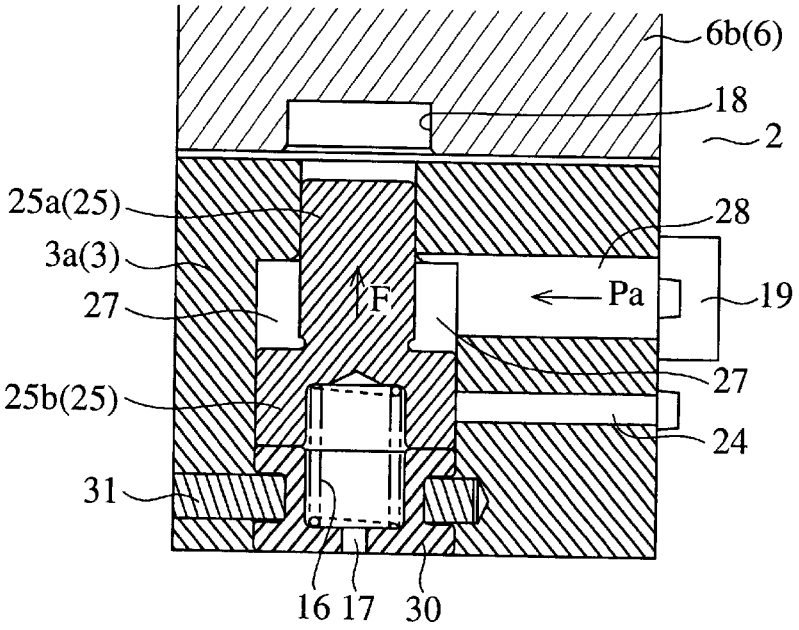

FIG. 17 is a lateral cross sectional view of an internal construction of a valve timing control device as embodiment 4 according to the present invention. FIG. 18 is a longitudinal cross sectional view taken along lines A—A of FIG. 17. FIG. 19 is an enlarged perspective view of a locking/unlocking mechanism of the valve timing control device shown in FIG. 17 and FIG. 18. FIG. 20A and FIG. 20B are longitudinal cross sectional views of an operation of the locking/unlocking mechanism of the valve timing control device shown in FIG. 17 to FIG. 19, FIG. 20A shows a locked state and FIG. 20B shows an unlocked state. Components of the embodiment 4 common to those of the conventional valve timing control device shown in FIG. 1 to FIG. 5 or those of the embodiment 1 are denoted by the same reference numerals and further description will be omitted.

With the embodiment 1 to the embodiment 3, the engagement hole is arranged at the first rotor and the locking member is arranged at the second rotor. On the other hand, the embodiment 4 is characterized in that the locking member is arranged at the first rotor and the engagement hole is arranged at the second rotor. Moreover, with the embodiment 1 to the embodiment 3, the locking member is slid in an axial direction of the device. On the other hand, the embodiment 4 is characterized in that the locking member is slid in a radial direction of the device.

With the embodiment 4, the engagement hole 18 is formed from the outer peripheral face of a boss section 6*b* of the rotor 6 in the radial direction of the device. The accommodation hole 14 is formed at one of the shoes 3*a* of the case 3 facing the outer peripheral face of the boss section 6*b* equipped with the engagement hole 18 in the radial direction of the device. The accommodation hole 14 accommodates the locking pin 25 allowing slide movement in the radial direction. A stopper 30 is press-fitted in the outermost section (of the device) of the accommodation hole 14 and prevents the locking pin 25 and the biasing means 16 arranged between the locking pin 25 and the stopper 30 from being popped out of the accommodation hole 14. The stopper 30 is fixed with a pin 31. The discharge hole 17 is formed at a central portion of the stopper 30.

The check valve 19 is arranged in the vicinity of the accommodation hole 14 in the shoe 3*a* above. The check valve 19 communicates to the advance side hydraulic chamber 9 through the advance side partitioned pressure path 22, and communicates to the retardation side hydraulic chamber 10 through the retardation side partitioned pressure path 23. The purge path 24 in the embodiment 4 is divided from the retardation side partitioned pressure path 23, and communicates the retardation side hydraulic chamber 10 to the backward pressurized section 14*a* in the accommodation hole 14. Moreover, the backward pressurized section 14*a* in the accommodation hole 14 of the embodiment 4 is a space defined between the locking pin 25 and the stopper 30. The third unlocking hydraulic pressure supply path 28 is disposed between the check valve 19 and the second unlocking hydraulic chamber 27.

An unlocking operation will be explained hereafter.

First, on starting the engine, as shown in FIG. 20A, the hydraulic pressure derived from the oil pump (not shown) is supplied mainly through the second oil path 12 to the retardation side hydraulic chamber 10. The retardation side hydraulic chamber 10 communicates to the second unlocking hydraulic chamber 27 by way of the retardation side partitioned pressure path 23, the check valve 19 and the third unlocking hydraulic pressure supply path 28. The chamber 10 communicates to the backward pressurized section 14*a* in the accommodation hole 14 by way of the retardation side partitioned pressure path 23 and the purge path 24. A hydraulic pressure mixing with residual air in the retardation side hydraulic chamber 10 and pipes on its way thereto is therefore supplied to the backward pressurized section 14*a* in the accommodation hole 14 and the second unlocking hydraulic chamber 27 by way of the purge path 24 as the hydraulic pressure is applied to the chamber 10. In this way, air mixed in the oil is discharged from the discharge hole 17 to outside of the device by way of the backward pressurized section 14*a*. Moreover, it is possible to produce a residual pressure in the backward pressurized section 14*a* in the accommodation hole 14 due to air-released oil supplied to the backward pressurized section 14*a*. The residual pressure P1 exerts on a back section (pressure-exerted area S2) of the locking pin 25 to move forward the locking pin 25. On the other hand, the retardation side hydraulic pressure Pr applied to the second unlocking hydraulic chamber 27 exerts on a shoulder section (pressure-exerted area S2–S1) of the locking pin 25 to move back the locking pin 25.

Here, the biasing force of the biasing means 16 is defined as F. When the following inequality (S2–S1)Pr–S2P1<F is established, the locking relation is not unlocked to keep the locked state. Here, since an inequality S1<S2 is established at all times, the left side of the inequality above is zero or less when Pr is nearly equal to P1. Therefore, even if the retardation side hydraulic pressure Pr is raised further to the maximum hydraulic pressure in the engine or the relief valve hydraulic pressure, it is impossible to unlock the locking relation due to the retardation side hydraulic pressure Pr. In this way, air or air-mixed oil having the potential for being used in first motion of the unlocking operation on starting the engine can be discharged positively to outside. Therefore, it is possible to prevent the occurrence of the beat noise (abnormal noise) with reliability when the locking relation is unlocked at a low hydraulic pressure.

Next, in the locked state, with reference to any operating conditions, an OCV (oil control valve, not shown) is controlled to switch the hydraulic pressure derived from the oil pump (not shown) to the advance side hydraulic chamber 9. At this time, the advance side hydraulic chamber 9 communicates to only the second unlocking hydraulic chamber 27 by way of the advance side partitioned pressure path 22, the check valve 19, and the third unlocking hydraulic pressure supply path 28. In contrast to the application of the retardation side hydraulic pressure Pr, the advance side hydraulic chamber 9 does not communicate to the backward pressurized section 14*a* in the accommodation hole 14. Therefore, the advance side hydraulic pressure Pa exerts only on the shoulder section (pressure-exerted area S2–S1) of the locking pin 25 in the second unlocking hydraulic chamber 27. In the process of raising the advance side hydraulic pressure Pa, the pressure Pa becomes a hydraulic pressure (unlocking hydraulic pressure) against the biasing force of the biasing means 16. That is, when the advance side hydraulic pressure Pa satisfies an inequality (S2–S1)Pa>F, the locking pin 25 starts moving back. The residual oil in the backward pressurized section 14*a* of the accommodation hole 14 is discharged quickly to outside of the backward pressurized section 14*a* through the purge path 24 and the discharge hole 17 as the locking pin 25 moves back due to the advance side hydraulic pressure Pa. Therefore, it is possible to unlock the locking pin 25 at a hydraulic pressure smaller than the unlocking hydraulic pressure based on the retardation side hydraulic pressure Pr by the residual pressure. Thus, the unlocking hydraulic characteristics on the application of the advance side hydraulic pressure Pa exhibits as in the case of the conventional one exhibiting no hysteresis as illustrated in FIG. 5. Finally, the locking pin 25 is released fully from the engagement hole 18 to finish the unlocking operation. In this way, it is possible to allow the free rotation of the first rotor 1 and the second rotor.

Moreover, due to the unlocking operation, as shown in FIG. 20B, the opening, which is close to a drain, of the purge path 24 is blocked with the outer periphery of the major diameter section 25*b* of the locking pin 25 moving back in the accommodation hole 14. In this way, in the unlocked state, the communication between the retardation side hydraulic chamber 10 and the backward pressurized section 14*a* in the accommodation hole 14 is blocked and accordingly the supply of hydraulic pressure derived from the retardation side hydraulic chamber 10 to the backward pressurized section 14*a* is cut off. As a result, it is possible to prevent the residual pressure from producing in the backward pressurized section 14*a*. The unlocking-keeping hydraulic pressure has magnitude adequate for competing against only the biasing force of the biasing means 16. In this way, it is possible to limit the unlocking-keeping hydraulic pressure smaller than the unlocking hydraulic pressure. Even if the application of the advance side hydraulic pressure is then switched again to that of the retardation side hydraulic pressure, it is possible to ensure the unlocked state in a low hydraulic pressure when the locking relation is unlocked at one time.

A locking operation will be explained hereafter.

When the engine is stopped, the oil pump (not shown) is also stopped. The oil in the valve timing control device therefore comes down to the oil pan (not shown). The hydraulic pressure in the second unlocking hydraulic chamber 27 is reduced, and the locking pin 25 moves forward due to the biasing force of the biasing means 16 to engage in the engagement hole 18. At this time, the locking operation is finished.

As described above, the components of the embodiment 4 are the same as those of the embodiment 1 to the embodiment 3, except that the locking pin 25 allowing to slide in the radial direction of the device is arranged at the first rotor and the engagement hole 18 is arranged at the second rotor. With the embodiment 4, air or air-mixed oil having the potential for being used in first motion of the unlocking operation on starting the engine can be discharged positively to out side as in the case of the embodiment 1 to the embodiment 3. Therefore, it is possible to unlock the locking relation after the applied hydraulic pressure reaches a level of allowing the control of the valve timing control device and to prevent the occurrence of the beat noise (abnormal noise) with reliability.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device, comprising:

a first rotor rotatable in synchronization with a crankshaft of an internal-combustion engine and having a plurality of shoes formed at an inner periphery of the first rotor;

a second rotor fixed at an end of an intake or exhaust camshaft of the internal-combustion engine, arranged in the first rotor, rotatable relative to the first rotor, and having a plurality of vanes formed at an outer periphery of the second rotor;

an advance side hydraulic chamber and a retardation side hydraulic chamber formed between the vanes of the second rotor and the shoes of the first rotor;

a locking member locking either of the first and second rotors with respect to the remainder at a required angle;

an accommodation hole arranged at either of the first and second rotors, accommodating the locking member and a biasing means biasing the locking member, and having a discharge hole discharging a backward pressure exerted on a back section of the locking member to outside; and an engagement hole arranged at the remainder, allowing the insertion of the locking member;

an unlocking hydraulic chamber; and an unlocking hydraulic pressure supply path supplying a hydraulic pressure to the unlocking hydraulic chamber; wherein at least one of the advance and retardation side hydraulic chambers is equipped with a purge path communicating to the atmosphere.

2. A valve timing control device according to claim 1, further comprising:

a check valve having an advance side partitioned pressure path communicating to the advance side hydraulic chamber and having a retardation side partitioned pressure path communicating to the retardation side hydraulic chamber, the check valve selecting the higher pressure of the two different pressures in the advance and retardation side hydraulic chambers to supply the selected pressure to the unlocking hydraulic pressure supply path, wherein at least one of the advance side hydraulic chamber, the retardation side hydraulic chamber, the advance side partitioned pressure path and the retardation side partitioned pressure path is equipped with a purge path communicating to the atmosphere.

3. A valve timing control device according to claim 2, wherein the purge path is connected to a backward pressurized section in the accommodation hole, the backward pressurized section functioning as a backward pressurized chamber for the locking member.

4. A valve timing control device according to claim 3, wherein a drain path communicating between the purge path and the atmosphere is connected to the backward pressurized section in the accommodation hole, the backward pressurized section functioning as a backward pressurized chamber for the locking member.

5. A valve timing control device according to claim 4, wherein the purge path communicates at least one of the retardation side hydraulic chamber, the advance side hydraulic chamber, the retardation side partitioned pressure path or the advance side partitioned pressure path to the atmosphere.

6. A valve timing control device according to claim 5, wherein the purge path is connected to the backward pressurized section in the accommodation hole so that the purge path is blocked with the locking member in a state of unlocking the locking relation.

7. A valve timing control device according to claim 6, wherein the purge path is connected to the backward pressurized section in the accommodation hole so that the purge path is blocked with the locking member over a period of time during from the state of starting a locking operation to the state of moving the locking member by a required stroke.

8. A valve timing control device according to claim 7, wherein at least one part of the purge path, the discharge hole, the drain path, the retardation side partitioned pressure path of the check valve or the unlocking hydraulic pressure supply path is equipped with a throttle for narrowing an opening area of them.

9. A valve timing control device according to claim 8, wherein an opening area of the purge path is set to be narrower than that of a pressurized chamber supply path supplying a hydraulic pressure to the advance side hydraulic chamber or the retardation side hydraulic chamber.

10. A valve timing control device according to claim 9, wherein the opening area of the purge path is set to be equal to or be larger than that of the discharge hole or the drain path.

11. A valve timing control device according to claim 10, wherein the opening area of the purge path is set to be larger than that of any one of the advance side partitioned pressure path, the retardation side partitioned pressure path and the unlocking hydraulic pressure supply path.

12. A valve timing control device according to claim 11, wherein opening areas of the pressurized chamber supply path, the purge path, the drain path and the unlocking hydraulic pressure supply path are so set as to satisfy the following inequality:

the pressurized chamber supply path $\geqq$ the purge path $\geqq$ the drain path $\geqq$ the unlocking hydraulic pressure supply path.

13. A valve timing control device according to claim 12, wherein the opening areas are so set as to produce a pressure different between an unlocking hydraulic pressure and an unlocking-keeping hydraulic pressure.

14. A valve timing control device according to claim 12, wherein a biasing force of a biasing means is so set as to produce a pressure different between an unlocking hydraulic pressure and an unlocking-keeping hydraulic pressure.

15. A valve timing control device according to claim 12, wherein a pressure-exerted area of a tier-equipped locking member is so set as to produce a pressure different between an unlocking hydraulic pressure and an unlocking-keeping hydraulic pressure.

16. A valve timing control device according to claim 15, wherein the unlocking hydraulic pressure of the locking member using either of the retardation side hydraulic pressure and the advance side hydraulic pressure is set to be larger than a maximum hydraulic pressure in the engine or a relief valve hydraulic pressure.

17. A valve timing control device according to claim 5, wherein when the first and second rotors are locked, a hydraulic chamber allowing entry of a hydraulic pressure on starting the engine communicates to an unlocking hydraulic chamber and the backward pressurized section in the accommodation hole, respectively.

18. A valve timing control device according to claim 17, wherein the locking member is released from the engagement hole due to a hydraulic pressure of a hydraulic chamber opposite to the hydraulic chamber allowing the entry of hydraulic pressure on starting the engine, and wherein when the first and second rotors are unlocked, the purge path defined between the hydraulic chamber allowing the entry of hydraulic pressure on starting the engine and the backward pressurized section in the accommodation hole is blocked with the locking member.

19. A valve timing control device according to claim 17, wherein the hydraulic chamber allowing the entry of hydraulic pressure on starting the engine is the retardation side hydraulic chamber.

* * * * *